US006382622B1

(12) United States Patent
Takada et al.

(10) Patent No.: US 6,382,622 B1
(45) Date of Patent: May 7, 2002

(54) SHEET FEEDING APPARATUS, IMAGE FORMING APPARATUS HAVING THE SAME, AND IMAGE READING APPARATUS HAVING THE SAME

(75) Inventors: Hideaki Takada; Takashi Yano, both of Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/570,687

(22) Filed: May 12, 2000

(30) Foreign Application Priority Data

| | | |
|---|---|---|
| May 13, 1999 | (JP) | 11-132395 |
| Aug. 2, 1999 | (JP) | 11-218436 |
| Apr. 20, 2000 | (JP) | 12-119061 |
| Apr. 20, 2000 | (JP) | 12-119062 |

(51) Int. Cl.[7] ..... B65H 3/52; B65H 3/34
(52) U.S. Cl. ..... 271/122; 221/167
(58) Field of Search ..... 271/122, 167, 271/104, 137

(56) References Cited

U.S. PATENT DOCUMENTS 5,216,473 A * 6/1993 Maeyama ..... 355/319 X
5,362,037 A * 11/1994 van der Werff ..... 271/10 X

* cited by examiner

*Primary Examiner*—Christopher P. Ellis
*Assistant Examiner*—Kenneth W Bower
(74) *Attorney, Agent, or Firm*—Fitzpatrick, Cella, Harper & Scinto

(57) ABSTRACT

The present invention relates to a sheet feeding apparatus comprising a sheet supporting means for supporting sheets, a feeding means for feeding the sheets on the sheet supporting means in a sheet feeding direction, a separating means for rotating in a direction opposite to the sheet feeding direction to separate the sheets sheet by sheet in pressurized contact with the feeding means and a transmitting means for transmitting drive force of the feeding means to the separating means. A circumferential speed of the separating means is set smaller than a circumferential speed of the feeding means.

33 Claims, 20 Drawing Sheets

SHEET FEEDING APPARATUS, IMAGE FORMING APPARATUS HAVING THE SAME, AND IMAGE READING APPARATUS HAVING THE SAME

BACKGROUND OF THE INVENTION

1. Field of the Invention

This invention relates to a sheet feeding apparatus for feeding sheets sheet by sheet by a retard separation method and to an image forming apparatus and an image reading apparatus such as a photocopier or printer having the sheet feeding apparatus.

2. Description of Related Art

FIG. 19 and FIG. 20 show a schematic cross section and a drive portion illustration of sheet feeding apparatuses of two types, respectively, capable of feeding sheets successively using representative retard separation methods that have been used conventionally. First, as the first prior art, a retard separation sheet feeding apparatus having a pickup roller is described in reference to FIG. 19.

A feeding motor M for driving the apparatus has a route to transmit the drive force to a feeding roller 203 and a pickup roller 202, and a route to transmit the drive force to a separating roller 204.

An one-way clutch 211 for limiting rotation in a direction opposite to the sheet feeding direction is formed at a feeding roller shaft 213.

The separating roller 204 formed in contact with the feeding roller 203 with a prescribed pressure is supported rotatively via a torque limiter 212 to a separating roller shaft 214 rotating in a direction opposite to the sheet feeding direction.

The pickup roller 202 feeds one sheet only out, and where the sheet is nipped at a nipping portion formed at a pressurized contact portion between the feeding roller 203 and the separating roller 204, the separating roller 204 rotates in association with the rotation of the feeding roller 203 in the sheet feeding direction, but where plural sheets come into the nipping portion between the feeding roller 203 and the separating roller 204 (hereinafter, this situation is referred to as "double feeding"), the torque limiter operates to render the separating roller 204 rotates in the direction opposite to the sheet feeding direction, thereby leaving the topmost one sheet only and returning other doubly fed sheets to a stacking plate 201.

The pickup roller 202 is controlled to feed the sheets stacked on the stacking plate 201 sheet by sheet in a direction of the feeding roller 203 and to escape from the sheet surface upon operation of a pickup solenoid 206 after the sheet fed reaches the nipping portion between the feeding roller 203 and the separating roller 204.

This is for avoiding operation by the separating roller 204 to return the sheets in the direction of the stacking plate 201from being disturbed when plural sheets are fed to the nipping portion.

In this prior art, the pickup roller 202 is rotatively supported around the feeding roller shaft 213 by a pickup supporting plate 215. According to whether a pickup lever 208 moving in association with the pickup solenoid 206 is pushing up the pickup supporting plate 215 or not, the pickup roller 202 switches the pickup roller's position for pressing to and escaping from the sheet S.

When a user sets a sheet bundle to this sheet feeding apparatus, the pickup roller 202 is structured to escape by the pickup solenoid 206 during non-operation period of the apparatus so as not to interfere the pickup roller 202 with the setting operation.

Where one sheet fed by the feeding operation and separated by the separating roller 204 is transferred to the nipping portion of the pulling-out roller pair 205 formed on a downstream side in the sheet feeding direction, a controlling means, not shown, stops drive of the feeding motor M1 until the sheet rear end passes the nipping portion between the feeding roller 203 and the separating roller 204. Where the feeding motor M1 stops drive, a stepping motor or the like is used which does not rotate in a direction opposite to the drive direction.

The reason that the drive of the feeding motor M1 is stopped is to prevent a sheet subsequent to the forgoing sheet from being fed together where the leading end of the sheet subsequent to the sheet being fed is conveyed right before the nipping portion between the feeding roller 203 and the separating roller 204.

The one-way clutch 111 is so formed that the feeding roller 203 can rotate along with the sheet until the sheet rear end passes the nipping portion even after the feeding motor M1 stops its drive.

In addition, when the user sets the sheet bundle, a shutter 210 is provided to give the user setting feeling to prevent the sheet bundle from reaching the nipping portion by mistaken control of the user, or to prevent pickup failure due to mistaken setting made by the user. The shutter 210 moves to a position to hit the sheet bundle during the non-operation period of the apparatus by a shutter solenoid 207, and during feeding operation, can escape to a position not disturbing the feeding operation.

Next, as a second prior art, a sheet feeding apparatus of a retard separation method not using any pickup roller is described using a schematic cross section shown as FIG. 20.

As shown in FIG. 20, sheets S stacked on an intermediate plate 306 in a cassette 307 are lifted together with the intermediate plate 306 by a pressing arm 308 and a sheet pressing spring 305 and is normally in pressurized contact with the feeding roller 301 to receive feeding pressure.

A separating roller 302 provides the feeding roller 301 retard pressure (separating roller pressure). In this state, if the feeding roller 301 rotates in a direction for feeding sheets, the sheet S in pressurized contact with the feeding roller 301 is fed out and reaches the nipping portion formed between the feeding roller 301 and the separating roller 302.

At that time, if the sheet S is solely nipped at the nipping portion, the separating roller 302 rotates together with the feeding roller 301 in a direction for feeding sheet by operation of a torque limiter 303 formed in a united body with the feeding roller 301, thereby feeding the sheet S.

However, if plural sheets are nipped at the nipping portion, the separation rotates in a direction to return the doubly fed sheets with a prescribed torque by operation of the torque limiter 303, thereby preventing the sheets from being doubly fed.

The two sheet feeding apparatuses using major retard separation methods are described above, but those sheet feeding apparatus suffer from the following problems.

With the sheet feeding apparatus of the first prior art, to use the retard separation feeding method, the pickup roller is necessary to feed the sheet from the sheet bundle sheet by sheet, and a escaping mechanism such as the shutter solenoid 207 and the like is required to escape the pickup roller 202.

Moreover, since the apparatus requires the mechanism made of the shutter 210 and the shutter solenoid 207, the apparatus also requires an installation space for the mechanism, and this compelled the apparatus to be larger. The mechanism further requires larger number of parts, makes the structure complicated, and renders the manufacturing costs higher.

In a meantime, there is a problem relating to paper jamming handling. Since one-way clutch 211 for limiting the rotation in the direction opposite to the sheet feeding direction is formed at the feeding roller 203, the feeding roller 203 does not rotate in the direction opposite to the sheet feeding direction. The sheets jammed at the nipping portion between the feeding roller 203 and the separating roller 204 can be pulled only on a side of the sheet feeding direction, so that it is required to do work such as removal of the apparatus to handle the paper jamming and that such a removal imposes a duty on the user. In addition, when the user forcibly pulls sheets in the direction opposition to the sheet feeding direction, the sheets may be broken, and the sheets left within the apparatus may cause further problems.

To solve the problems relating to the first prior art, the second prior art has been conceived as a retard separation method as a type not using such a pickup roller. With this structure, the feeding operation is made without using any pickup roller, so that the apparatus structure is made simple, and so that the structure is very advantageous in terms of costs and installation space.

However, with this structure, the sheets S stacked on the intermediate plate 306 in the cassette 307 are lifted together with the intermediate plate 306 by the sheet pressing spring 305 and is normally in pressurized contact with the feeding roller 301. Therefore, the intermediate plate pressure plays the major role to the feeding operation and separation operation.

The intermediate plate pressure exerted by the sheet press spring 305 may vary depending on the stacked number of the sheets in the cassette 307, so that feeding and separation conditions are different between when the sheets are fully stacked and when the sheets are stacked in a small number.

Since the sheets S are normally in pressurized contact with the feeding roller 301, the stacked sheets S always receive the intermediate plate pressure. When the user tries to return the separated doubly fed sheets to the original position, the doubly fed sheets may not be returned smoothly because the sheet bundle is nipped by the feeding roller 301 and the intermediate plate 306.

Accordingly, the returning force by the torque limiter 303 is required to be set larger in order to prevent such double feeding in this mechanism.

On the downstream side of the feeding roller 301 and the separating roller 302 in the sheet feeding direction, a conveyance roller pair is generally formed. Such a conveyance roller pair has to pull the normally pressed sheets S from the nipping portion between the feeding roller 301 and the separating roller 302, so that the load exerted to the conveyance roller pair becomes large, and so that the lifetime of the conveyance roller pair becomes shorter.

In addition, not only the intermediate plate pressure, but the torque limiter 303 formed at the separating roller 302 gives a torque in a direction opposite to the sheet feeding direction, so that the torque also gives effects as a load to the conveyance roller pair. Therefore, as the higher the torque value of the torque limiter, the larger the load exerted to the conveyance roller pair.

That is, if the apparatus has higher separation property, the conveyance roller pair is worn out early due to increased pulling load at the conveyance roller pair, and to the contrary, if the pulling load is reduced at the conveyance roller pair, the sheet separation property may be sacrificed.

SUMMARY OF THE INVENTION

This invention is conceived in consideration to the above problems. It is an object of the invention to provide a sheet feeding apparatus, as well as an image forming apparatus and an image reading apparatus having the sheet feeding apparatus, in which durability of conveying means and high separation function are compatible by performing stable feeding and separation operation with a very simple structure and by reducing a load exerted to a conveying means placed on a downstream side of a feeding means in a sheet feeding direction. The sheet feeding apparatus includes sheet supporting means for supporting sheets, feeding means for feeding in a sheet feeding direction the sheets fed from the sheet supporting means, and separating means for rotating in a direction opposite to the sheet feeding direction to separate the sheets sheet by sheet in pressurized contact with the feeding means, wherein the circumferential speed of the separating roller is set lower than the circumferential speed of the feeding roller.

DESCRIPTION OF THE PREFERRED EMBODIMENTS

An embodiment embodying a sheet feeding apparatus according to the present invention will be explained in detail utilizing a copying machine as an image forming apparatus.

Figure 1:
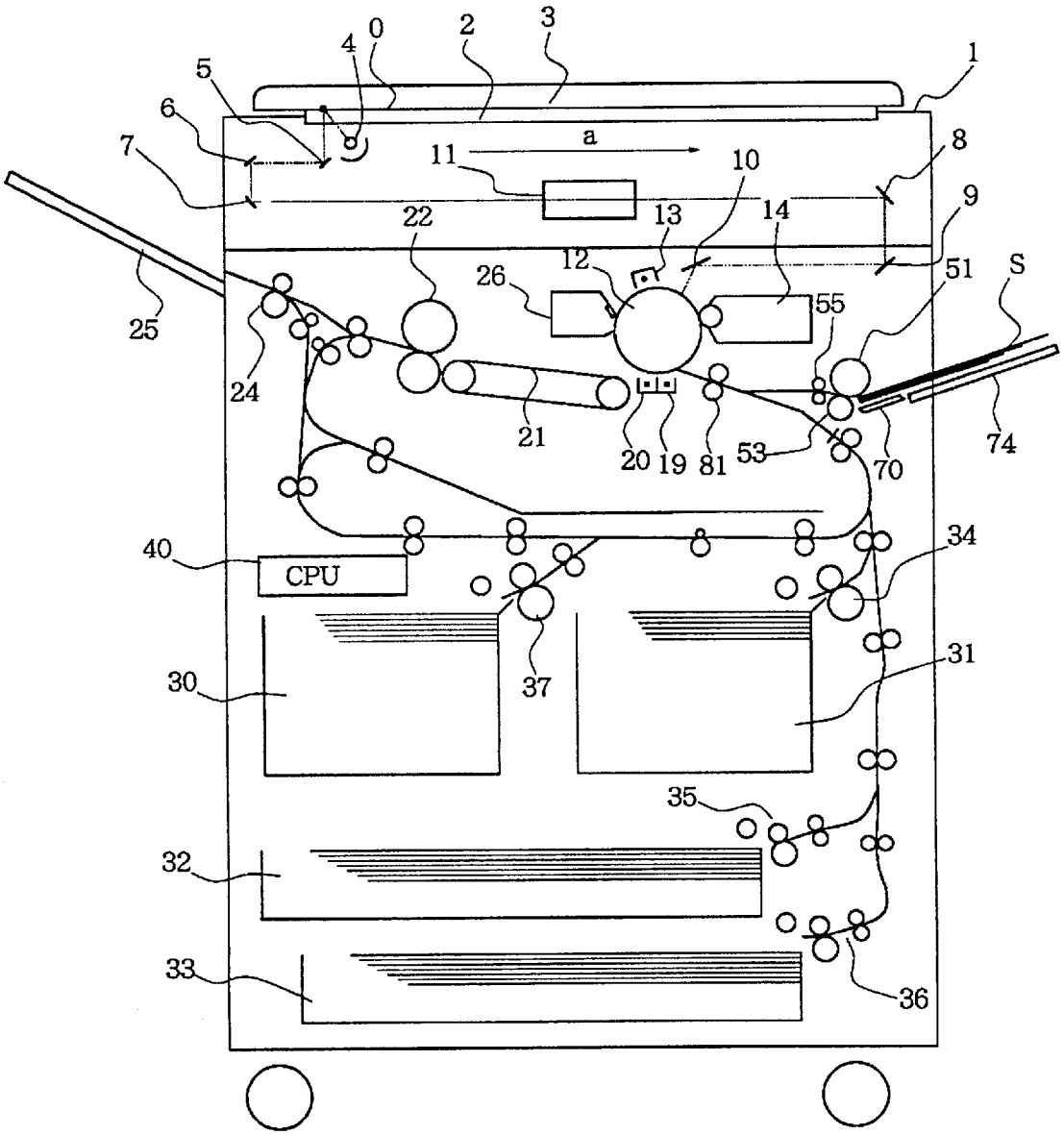
FIG. 1 is a cross section of a photocopier as an image forming apparatus having a sheet feeding apparatus according to an embodiment.

First, the embodiment according to the present invention will be explained with reference to FIGS from FIG. 1 to FIG. 7. FIG. 1 is a cross-sectional view showing a copying machine as an image forming apparatus having a sheet feeding apparatus according to the present invention.

In FIG. 1, numeral 1 refers to a main body of a copying machine, and an original document board 2 constituted of a fixedly provided transparent glass plate is provided in an upper portion of the main body 1 of the copying machine. Numeral 3 refers to an original document pressing and fixing plate for pressing and fixing an original document O rested on the original document board 2 at a predetermined position with an image surface of the original document O facing down. Below the original document board 2, provided is an optical system including a lamp 4 for illuminating the original document O, reflecting mirrors 5, 6, 7, 8, 9, 10 for directing a light image of the illuminated original document O to a photosensitive drum 12, and an imaging lens 11. Incidentally, the lamp 4 and the reflecting mirrors 4, 5, 6, 7 are moved at a predetermined speed in a direction indicated by the arrow A to scan the original document O.

An image forming section as an image forming means includes the photosensitive drum 12, a charger 13 for uniformly charging the surface of the photosensitive drum 12, a developing unit 14 for forming toner images to be transferred to a sheet S by developing an electrostatic latent image formed with the light image radiated from the optical system on the surface of the photosensitive drum 12 charged by the charger 13, a transfer charger 19 for transferring the toner image developed on the surface of the photosensitive drum 12 onto the sheet S, a separation charger for separating the sheet S to which the toner image is transferred from the photosensitive drum 12, and a cleaner 26 for removing residual toner from the photosensitive drum 12 after the transferring of the toner image.

On a downstream side of the image forming section, there are provided a transporting section 21 for transporting the sheet S to which the toner image is transferred, and a fixing unit 22 for fixing, as a permanent image, the image onto the sheet S transported by the transporting section 21.

Also, delivering roller 24 for delivering the sheet S, on which the image is fixed by the fixing unit 22, out of the main body 1 of the copying machine is provided, and a delivering tray 25 for receiving the sheet S delivered by the delivering roller 24 is provided outside the main body 1 of the copying machine.

In addition to the multi-feeding section for separating and feeding, sheet by sheet, the sheet S set on the sheet feeding tray 74, it is also possible that the sheets contained in sheet feeding decks 30, 31 or in cassettes 32, 33 are fed by separating and conveying rollers 34, 35, 36, 37 to the image forming means.

It is also possible that a sheet which finishes image forming on one side of the surfaces is reversed, in terms of the front and back faces, through a re-feeding path 38 to be conveyed again to the image forming section where image is formed on the other side of the surfaces, and thereafter delivered to the delivery tray 25.

Figure 2:
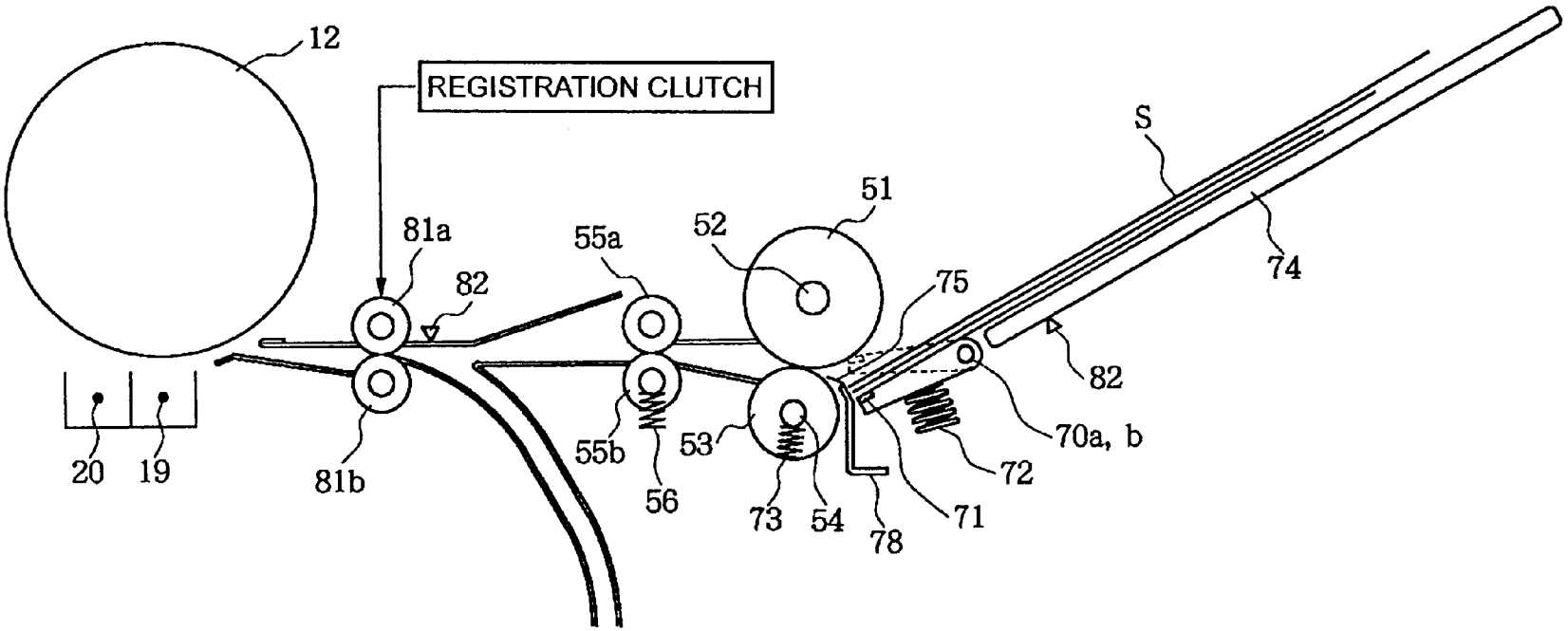
FIG. 2 is a cross section of a multiple feeding portion and a drum portion in the sheet feeding apparatus.
Figure 3:
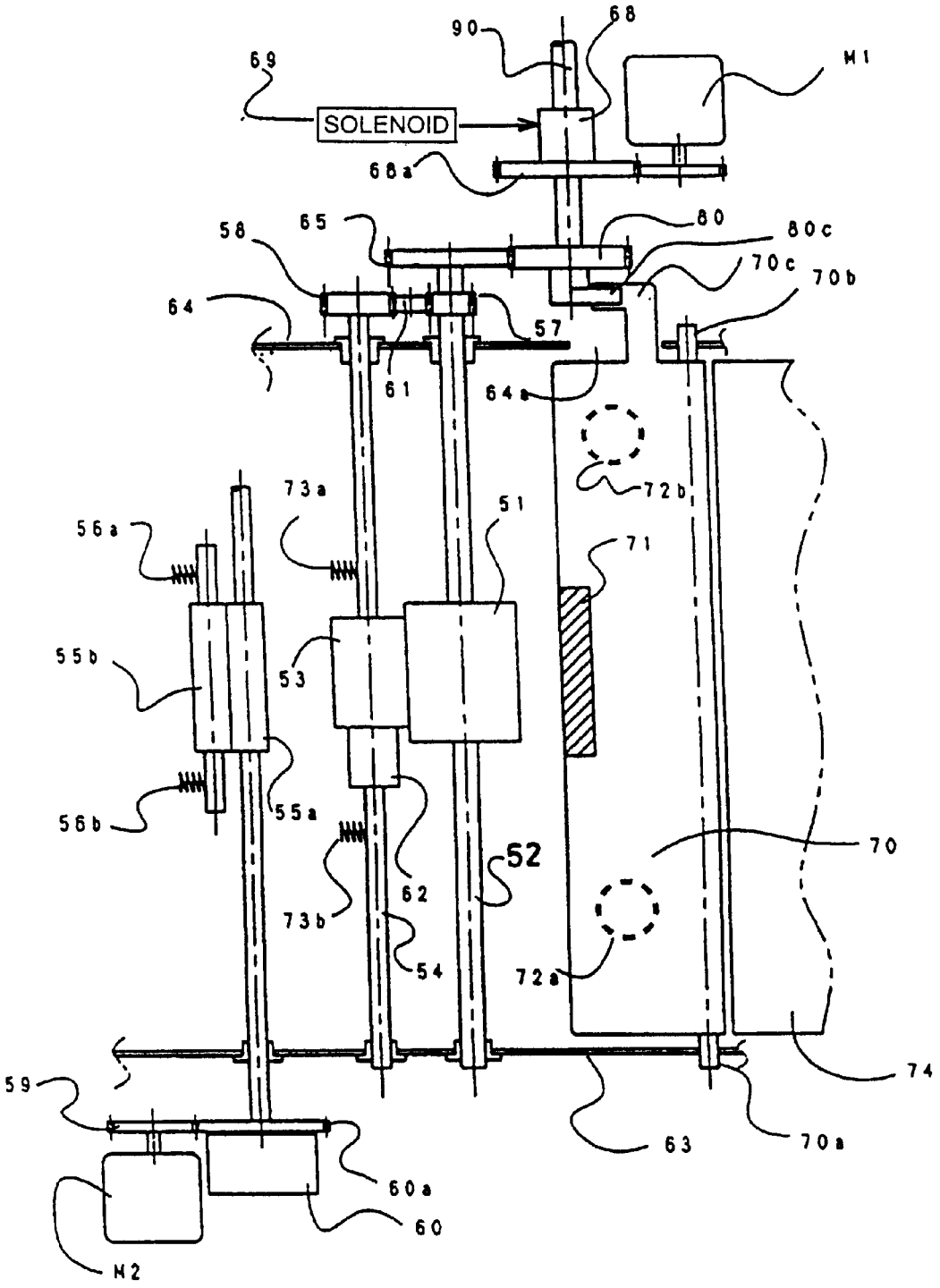
FIG. 3 is an expanded diagram for drive of the multiple feeding portion in the sheet feeding apparatus.

Next, the multi-feeding section will be described. FIG. 2 is a cross-sectional view of the multi-feeding section and the drum section, and FIG. 3 is a drive development view (plan view) of the multi-feeding section.

In the main body 1 of the copying machine, a multi-sheet feeding tray 74 for stacking and supporting a sheet bundle S is provided. The multi-sheet feeding tray 74 is provided with a sheet detecting sensor 82 constituted of a photo-interrupter or the like for detecting presence or absence of the sheets S on the tray 74.

Also, it is so structured that an intermediate plate 70 as a supporting member for supporting sheets is provided so as to pivotally move around fulcrums 70*a*, 70*b* as points of support with respect to a front side plate 63 and a rear side plate 64, and is urged with moment toward a clockwise direction in FIG. 2 (a direction of pressing a sheet feeding roller 51) by pressing springs 72*a*, 72*b* (72).

The intermediate plate 70 can suitably conduct pressing operation (a state as shown by a broken line in FIG. 2) and pressure releasing operation (a state as shown by a solid line in FIG. 2) by a driving section, thereby capable of pressing the stacked sheets S with respect to the sheet feeding roller 51, or releasing the sheets S from the pressure.

Further, a felt 71 for preventing double-feed of the sheets S as well as for relieving shock on the intermediate plate 70 during the pressing operation is provided at a directly contacting portion of the intermediate plate 70 with the sheet feeding roller 51.

The sheet feeding roller 51 as a sheet feeding means is secured to a sheet feeding roller shaft 52, and the sheet feeding roller shaft 52 is pivotally supported, so as to be rotatable, by the front side plate 63 and the rear side plate 64.

Furthermore, a sheet feeding driving gear 65 and a drive transmitting gear 57 as a transmitting means are secured to a rear end of the sheet feeding roller shaft 52. A driving gear 58, drivingly connected as an opposite by an idler gear 61 which is connected to the drive transmitting gear 57 of the sheet feeding roller shaft 52, is secured to a separating roller shaft 54. Thus, the separating roller shaft 54 is synchronized with the sheet feeding roller shaft 52 to rotate in a direction opposite to the sheet feeding roller shaft 52.

The separating roller 53 as a separating means is rotatably provided on the separating roller shaft 54 via a torque limiter 62 for generating a predetermined torque. This separating roller 53 is provided so as to face oppositely to the sheet feeding roller 51 and press the sheet feeding roller 51 at a predetermined pressure by springs 73*a*, 73*b*, (73) via bearings (not shown).

Incidentally, as mentioned above, the separating roller shaft 54 rotates in synchronization with the sheet feeding roller 51, and the separating roller shaft 54 is driven to rotate the separating roller 53 in a direction opposite to the sheet conveying direction of the sheet feeding roller 51.

The torque value of the torque limiter 62 and the pressure of the pressing springs 73*a*, 73*b* of the separating roller 53 are selected so that the separating roller 53 follows the sheet feeding roller 51 by frictional force (or stops when the sheet feeding roller 51 stops) when only one sheet or no sheet exists in a nip as a separating portion formed by the sheet feeding roller 51 and the separating roller 53, and that the separating roller 53 rotates reversely so as to generate restoring force only when two or more sheets exist in the nip.

The rotational driving of the sheet feeding roller 51 and the separating roller 53 as well as the pressing and estranging operation of the intermediate plate 70 are carried out by rotations of a notched gear 80 having partially toothless portion as a driving means and a cam 80*c* provided with the notched gear 80 as a pressing and estranging means.

At a position to which the sheet feeding driving gear 65 which is secured to the sheet feeding roller shaft 51 is opposed for engagement, provided is the notched gear 80 engaging with the sheet feeding driving gear 65 and having two toothless portions (non-engagement portions) 80*a*, 80*b*.

Figure 4:
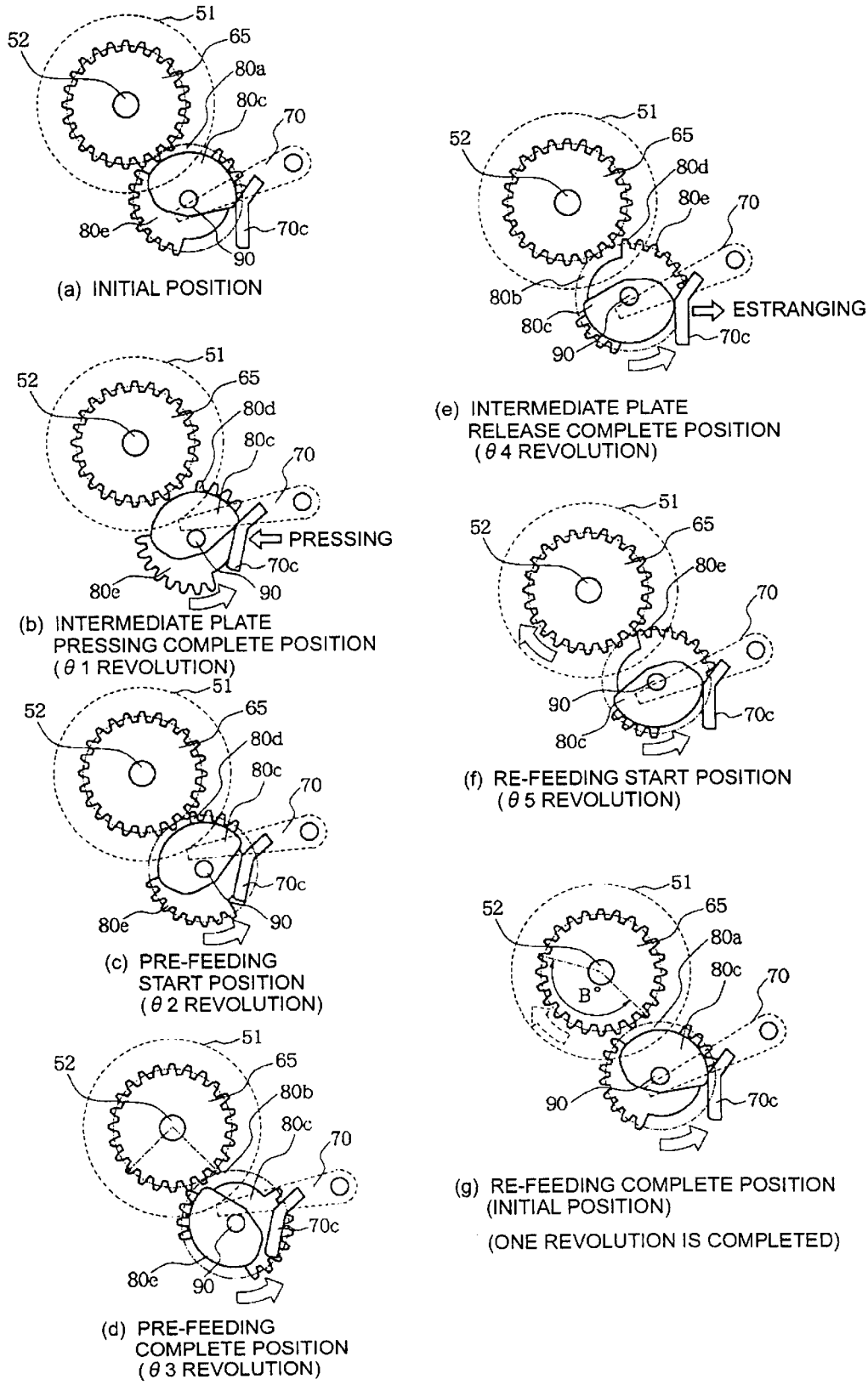
FIG. 4 is an illustration showing operation states of notched gears.

As shown in FIG. 3 and FIG. 4, a cam 80*c* for pressing and pressure releasing operations of the intermediate plate 70 with respect to the sheet feeding roller 51 is integrally formed with the notched gear 80.

Provided with the intermediate plate 70 is a cam follower 70*c* extending to a position the cam 80*c* directly contacts therewith, thereby regulating the rotation of the intermediate plate 70 in a clockwise direction in FIG. 2. The notched gear 80 is secured to a driving shaft 90 to which the driving force from the driving source is transmitted, and furthermore, a spring clutch 68 as a fixed amount rotating means for rotating the notched gear 80 by a predetermined amount is provided on the driving shaft 90.

One revolution of the spring clutch 68 is controlled by turning ON a controlling solenoid 69 as a fixed amount rotating means by a time of T1 (sec), and phase angles of the spring clutch 68 and the toothless portion 80*a* are selected so that the toothless portion 80*a* of the notched gear 80 is normally positioned opposite to the sheet feeding driving gear 65.

With this arrangement, in an initial state, the sheet feeding driving gear 65, the sheet feeding roller shaft 52, and the sheet feeding roller 51 are freely rotatable in any directions although affected by the rotating load of the torque limiter 62.

A pair of draw rollers 55*a*, 55*b* (55) as conveying means is disposed on a downstream side of the sheet feeding roller 51 in the sheet conveying direction. The draw driving roller 55*a* is pivotally supported, to be rotatable, by respective front side plate 63 and rear side plate 64 via bearings (not shown). On an end of a shaft to which the draw driving roller 55*a* is connected, as shown in FIG. 3, there is disposed a draw clutch 60 constituted of an electromagnetic clutch so that driving force from a draw motor M2 can be connected and disconnected via gears 59 and 60*a*.

In addition, the draw driven roller 55b is pressed by springs 56*a*, 56*b* (56) via a bearing member (not shown) so as to oppose to the draw driving roller 55*a*. Thus, when the draw clutch 60 is turned ON, the driving force of the draw motor M2 is transmitted for rotating the pair of draw rollers 55 in the sheet conveying direction.

In addition, a hitting plate 78 serving as a hitting portion when a user sets the sheets S on the multi-sheet feeding tray 74 is secured between the separating roller 53 and the intermediate plate 70.

At a tip of the hitting plate 78, there is provided a leading guide 75 formed of a thin plate such as polyethylene sheet, SUS material or the like for guiding a leading end of the sheet to the nip formed by the sheet feeding roller 51 and the separating roller 53, and this, as a result, prevents the leading end of the sheet from curling or bending caused when the leading end of the sheet hits the separating roller 53.

Next, structures of the driving means of the sheet feeding roller 51 and the intermediate plate 70 will be specifically described with reference to FIG. 4 and FIG. 5.

As mentioned above, at a position to which the sheet feeding driving gear 65 opposes for engagement, there is provided the notched gear 80 formed integrally with a first gear portion 80*d* and a second gear portion 80*e* capable of engaging with the sheet feeding driving gear 65, two toothless portions 80*a*, 80*b*, and the cam 80*c* as a pressing and estranging means for conducting the pressing and pressure releasing operations of the intermediate plate 70. As mentioned above, it is so structured that the one revolution of this notched gear 80 is controlled by the spring clutch 68 and the solenoid 69.

As for the notched gear 80, in the initial status, the phase angle of the spring clutch 68 and the configuration of the first toothless portion 80*a* are selected so that the first toothless portion 80*a* of the notched gear 80 is opposed to the sheet feeding driving gear 65. Therefore, the sheet feeding roller shaft 52 and the separating roller shaft 54 connecting to the sheet feeding roller shaft 52 so as to transmit the driving thereto are rotatable, independently of the notched gear 80.

Also, the cam 80*c* is directly contacted with the cam follower 70*c* disposed at the end of the intermediate plate, and the cam configuration and the phase angle with the first toothless portion 80*a* are selected so that the intermediate plate 70 is normally urged by the pressing spring 72 so as to be estranged.

As a result, the user, when setting a sheet bundle, can set easily the sheet bundle until the sheet bundle is directly contacted with the hitting board 78, since the intermediate plate 70 is estranged from the sheet feeding roller 51 during that time.

Next, operations of the aforementioned sheet feeding roller 52 and the driving means will be described.

Turning ON the solenoid 69 only by a time of T1 (sec) carries out, by the action of the spring clutch 68, one revolution of the notched gear 80. The notched gear 80 starts rotating from a state in FIG. 4(*a*) in a counterclockwise direction, and the cam 80*c* first rotates from a intermediate plate estranging position to a intermediate pressing position θ1.

Accordingly, the cam follower 70*c* of the intermediate plate 70 follows this movement, thereby making the intermediate plate 70 pressing with the sheet feeding roller 51. Consequently, a topmost sheet of the sheet bundle S stacked on the sheet feeding tray 74 as well as on the intermediate plate 70 is directly contacted and pressed with respect to the sheet feeding roller 51 (state in FIG. 4(*b*) and FIG. 5(*b*)).

When the notched gear 80 is further rotated up to a position θ2, the first gear portion 80*d* provided in the notched gear 80 is engaged with the sheet feeding driving gear 65 to rotate the sheet feeding driving gear 65 only through a predetermined angle A°.

According to this rotation, the sheet feeding roller 51 is rotated through the angle A° to feed out the topmost sheet in the sheet bundle by a predetermined amount L1 (the sheet feeding operation till now is referred to as "pre-feeding operation" hereinafter) (state in FIG. 4(*c*), (*d*) and FIG. 5(*c*), (*d*)).

Provided that an outer diameter of the sheet feeding roller 51 is D, a feeding amount L1 in the pre-feeding operation is represented by the following formula:

$$L1 = A° \times \pi \times D/360° \quad \text{(Formula 1)}$$

Incidentally, the number of teeth of the first gear portion 80*d* is selected so that the sheet feeding amount L1 during the pre-feeding becomes larger than a distance La from the sheet hitting plate 78 to the nip formed by the sheet feeding roller 51 and the separating roller 53 as well as smaller than a distance Lb from the nip position to the pair of draw rollers 55.

Due to this, the leading end of the sheet S thus pre-fed can be surely stopped at a position between the position of the nip formed by the sheet feeding roller 51 and the separating roller 53 and the position of the nip of the pair of the draw rollers 55.

Incidentally, the rotating speed of the sheet feeding motor M1 (see, FIG. 3), and the number of the teeth, the roller diameter or the like of the respective gears such as a transmitting gear 68*a* or the like are selected so that the rotating speed of the sheet feeding driving gear 65 is determined to make the sheet feeding speed of the sheet feeding roller 51 approximately the equal to or a little slower than the feeding speed of the pair of draw rollers 55 or a pair of registration rollers 81*a*, 81*b* (81).

Figure 5:
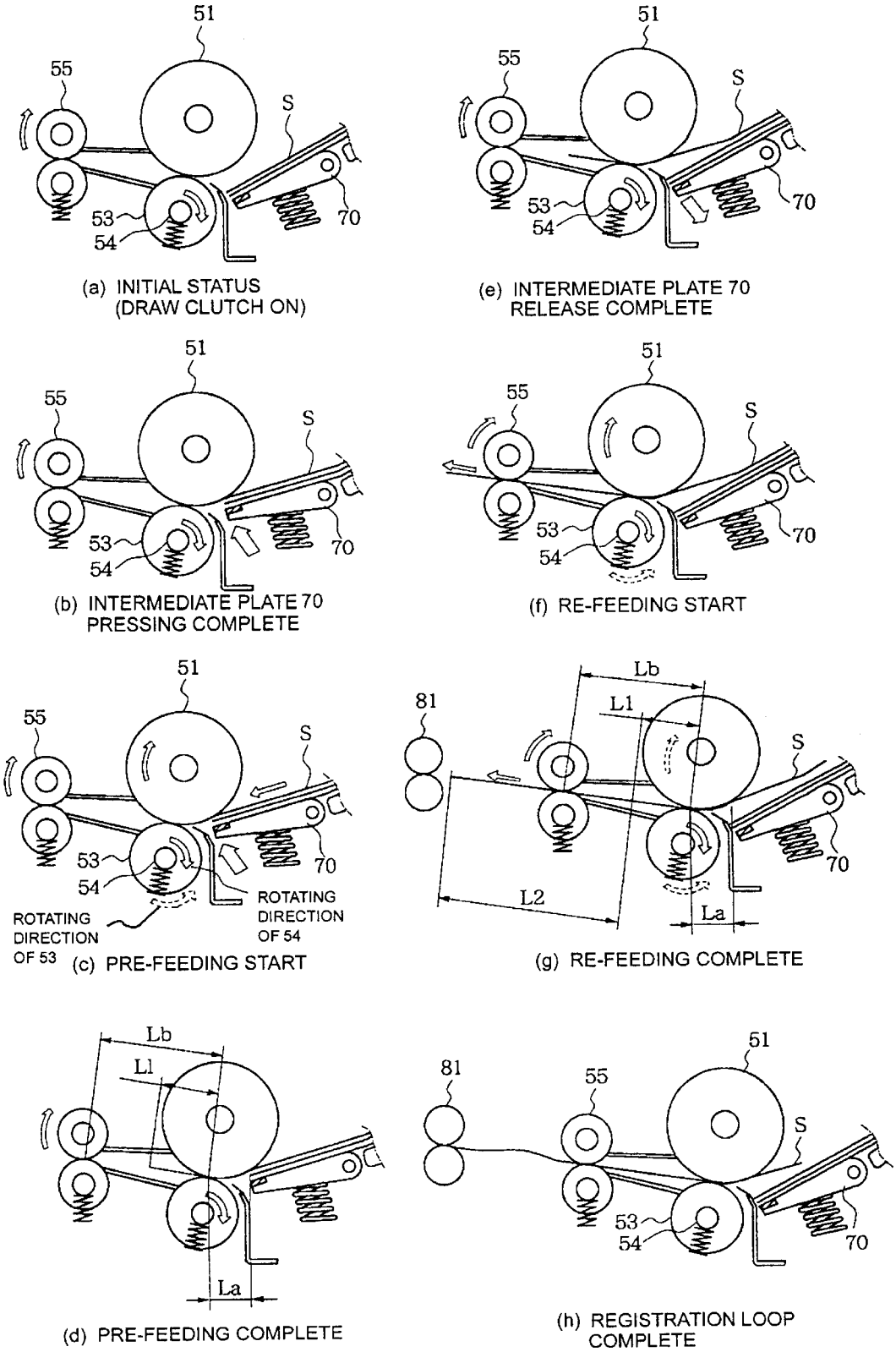
FIG. 5 is an illustration showing operation states of feeding portion.

Then, when the notched gear 80 is further rotated up to a position θ3 and the second toothless portion 80*d* reaches the position to which the sheet feeding driving gear 65 is opposed for engagement (state in FIG. 4(*d*), FIG. 5(*d*)), the driving force is not transmitted to the sheet feeding driving gear 65, thereby stopping the sheet feeding roller 51 temporarily.

Incidentally, since the number of teeth of the first gear portion 80*d* is selected in a way as mentioned above, regardless of the sheet feeding starting position of the sheet S, the leading end of the sheet fed by the amount L1 in the pre-feeding operation can surely be stopped temporarily between the nip and the pair of draw rollers 55.

Thereafter, when the notched gear 80 is further rotated up to a position θ4 to return the cam portion 80*c* to the intermediate plate estranging position, the cam follower 70*c* of the intermediate plate 70 follows this movement to estrange the intermediate plate 70 from the sheet feeding roller 51 (state in FIG. 4(*e*) and FIG. 5(*e*)).

When the notched gear 80 is further rotated up to a position θ5, the second gear portion 80*e* of the notched gear 80 is engaged with the sheet feeding driving gear 65 (state in FIG. 4(*f*) and FIG. 5(*f*)), and this movement resumes the rotation of the sheet feeding driving gear 65, and then the sheet feeding driving gear 65 is rotated only through a predetermined angle B°. Accompanied by this rotation, the sheet feeding operation by the sheet feeding roller 51 is resumed (the sheet feeding operation after pre-feeding operation is referred to as "re-feeding" hereinafter). The feeding amount L2 by the sheet feeding roller 51 at this time becomes $$L2=B^\circ\times\pi\times D/360^\circ \qquad \text{(Formula 2)}$$

The number of teeth of the second gear portion 80*e* is selected so that the feeding amount L2 in the re-feeding operation becomes an amount which can surely bring the leading end of the sheet fed in front of the pair of draw rollers 55 in the pre-feeding operation at least to the pair of draw rollers 55, but does not bring the leading end of the sheet to the pair of registration rollers 81.

Then, the rotation of the notched gear 80 is further advanced, and when the first toothless portion 80*a* reaches the position to which the sheet feeding driving gear 65 is opposed, the sheet feeding driving gear 65 does not receive the driving force, thereby stopping the rotation of the sheet feeding roller 51. Then, the notched gear 80, after finishing one revolution, is stopped at the initial position (state in FIG. 4(*g*) and FIG. 5(*g*)).

Figure 6:
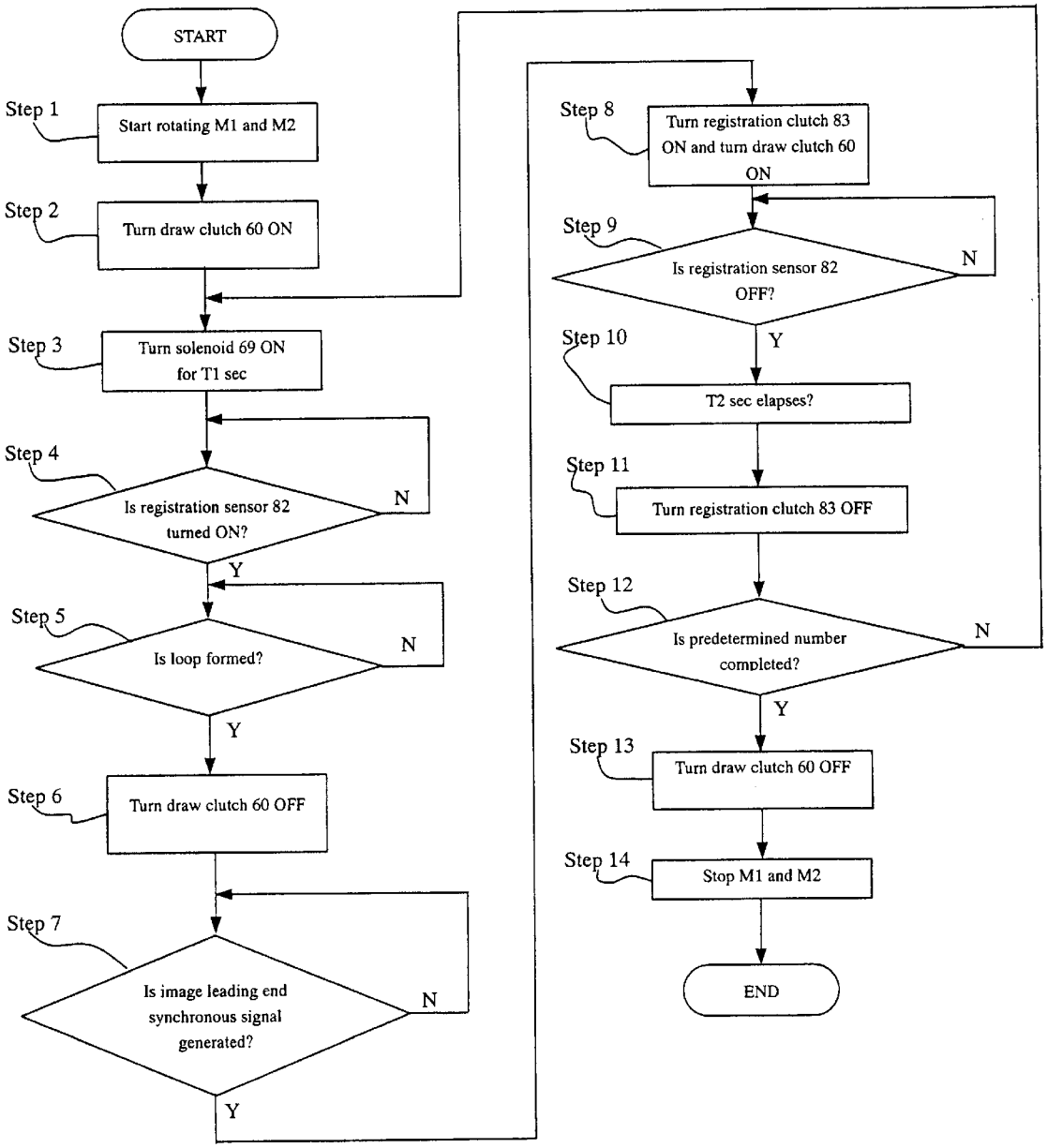
FIG. 6 is a flowchart at a time of feeding.

Next, the operation of sheet feeding from the multi-feeding section will be explained with reference to a flow-chart shown in FIG. 6 and a timing chart shown in FIG. 7.

In a state that the sheet bundle S is stored on the sheet feeding tray 74, when a start button (not shown) is pressed, the draw motor M2 and the sheet feeding motor M1 start to rotate respectively (step 1), and an ON signal of the draw clutch 60 is issued from a CPU 40 (step 2). Consequently, the pair of draw rollers 55 start to rotate in the sheet conveying direction.

Next, after a predetermined time is elapsed, a signal from the CPU 40 turns ON the solenoid 69 by a time of T1 (sec) (Step 3) to start the control of one revolution of the notched gear 80. By this operation, as mentioned above, the intermediate plate 70 is first pressed with the sheet feeding roller 51.

Then, the sheet feeding roller 51 is rotated only through a predetermined angle A°, and the topmost sheet S stacked on the tray 74 is conveyed by a predetermined amount L1 by the pressure of the intermediate plate 70 and the friction force of the surface of the sheet feeding roller 51 (pre-feeding operation).

At this time, since the separating roller shaft 54 is synchronized with the sheet feeding roller shaft 52 to rotate in a direction opposite to the sheet conveying direction, a predetermined restoring force is generated in the separating roller 53 by torque generated by the torque limiter 62.

Since the frictional force trying to rotate the separating roller 53 in the conveying direction exceeds the restoring force before the sheet enters into the nip portion between the sheet feeding roller 51 and the separating roller 53, or when only single sheet is fed, the separating roller 53 is driven to rotate in the sheet feeding direction by following the rotation of the sheet feeding roller 51.

On the other hand, when two or more sheets are fed together in an overlapped state (what is called double-feed), the separating roller 53 tries to operate so as to the double-fed sheets, because the restoring force exceeds the frictional force between the sheets.

In the above-mentioned pre-feeding operation, since the intermediate plate 70 is pressed with the sheet feeding roller 51 by the intermediate plate spring 72, the separating operation by the separating roller 53 may be obstructed, with the result that the double-fed sheets may not be restored.

Therefore, when the notched gear 80 is further rotated to stop temporarily the sheet feeding roller 51, the intermediate plate 70 is released from the pressure of the sheet feeding roller 51 and estranged from the sheet feeding roller 51, by the operation of the cam 80*c* and the cam follower 70*c*.

Since the cam 80*c* carries out the pressing and estranging operation of the intermediate plate 70, the pressure releasing operation with respect to the sheet feeding roller 51 can be carried out at a predetermined timing, regardless of the number of stacked sheets, by stopping temporarily the sheet feeding operation, during which stopping time the intermediate plate 70 is estranged from the sheet feeding roller 51.

When the rotation of the notched gear 80 is further advanced, the sheet feeding roller 51 starts the re-feeding operation, and therefore, the conveyance of the sheet S, stopped temporarily, is resumed to deliver a leading end of the sheet S to the pair of draw rollers 55. After the sheet feeding roller 51 conveys the sheet by a predetermined amount Lb in the re-feeding operation, the notched gear 80 finishes the fixed amount rotation, and the driving of the sheet feeding roller 51 is finished.

However, since the pair of draw rollers 55 continue to rotate, the sheet S is conveyed to the pair of registration rollers 81. During this time, the first toothless portion 80*a* of the driving gear 80 is disposed opposite to the sheet feeding driving gear 65, so the sheet feeding roller 51 is subjected to the frictional force in the conveying direction from the sheet S conveyed by the pair of draw rollers 55, with the result that the sheet feeding roller 51 is rotatively driven until a trailing end of sheet S passes through the nip portion between the sheet feeding roller 51 and the separating roller 53.

In this embodiment, even if, in this drawing operation, a succeeding sheet S is almost driven to be fed, the separating roller driving shaft 54 normally rotates in a direction pushing back the sheet S when the sheet feeding roller 51 rotates, and in addition, the intermediate plate 70 is already estranged from the sheet feeding roller 51, and therefore, the separating roller 53 starts, at this point, to rotate reversely to push back the double-fed sheets. Consequently, the double-feed is prevented beforehand.

As explained till now, the sheet S fed by the fixed amount rotation of the sheet feeding roller 51 is then conveyed by the pair of draw rollers 55 to the pair of registration rollers 81 disposed on a further downstream side. At this time, the pair of draw rollers 55 draw the sheet S from the nip between the sheet feeding roller 51 and the separating roller 53.

In this embodiment having such a structure that the pressure of the intermediate plate 70 is not given to the sheet feeding roller 51 during the drawing operation, the load given to the pair of draw rollers 55 becomes less in comparison with that of the second prior art.

However, because this embodiment has a structure having no pick-up rollers for feeding out the sheet to the sheet feeding roller 51, circumferential speed of the separating roller 53 is set smaller than that of the sheet feeding roller, in order to prevent a sheet returned in the separating operation from being largely returned to a position with which the sheet feeding roller 51 does not directly contact, as well as in order to further reduce the load applying to the pair of draw rollers 55, thereby prolonging the enduring lifetime of the pair of draw rollers 55.

As mentioned above, the driving force for rotating the separating roller 53 (force for rotating the separating roller shaft 54 in a direction opposite to the sheet conveying direction) is transmitted by gears from the sheet feeding roller shaft 52.

Provided that a restoring force required for the separating roller 53 to provide the sheet S for separating operation is Fr, a torque of the torque limiter 62 acting on the separating roller 53 is T (N·m), a radius of the sheet feeding roller 51 is Rf (m), and a radius of the separating roller 53 is Rs (m), the restoring force required for the separating roller 53 to provide the sheet S for separating operation is given by the following formula.

$$Fr=T/Rs \quad \text{(Formula 3)}$$

In this state, a force F for drawing the sheet S in the conveying direction from the nip between the sheet feeding roller 51 and the separating roller 53 is made by adding a force Fp required for rotating the sheet feeding roller 51 in the sheet feeding direction to a force Fs required for rotating the separating roller 53 in the sheet feeding direction.

Since the separating roller 53 is driven to be rotated in the sheet feeding direction against a direction opposite to the sheet feeding direction, a force Fs required for rotating the separating roller 53 in the sheet feeding direction is given by the following formula.

$$Fs=T/Rs \quad \text{(Formula 4)}$$

According to Formula 3, Fs is equal to Fr (Fs=Fr).

A force Fp required to rotate the sheet feeding roller 51 in the sheet feeding direction is determined by a load of the torque limiter 62 generated by the rotation, in the sheet feeding direction, of the separating roller 53 connected to the sheet feeding roller 51.

Here, provided that a circumferential speed of the sheet feeding roller 51 is Vf, a circumferential speed of the separating roller 53 is Vs, and rotating speeds of the sheet feeding roller 51 and the separating roller 53 is Nf and Ns respectively, the following formulas are provided.

$$Nf=Vf/Rf \quad \text{(Formula 5)}$$

$$Ns=Vs/Rs \quad \text{(Formula 6)}$$

Provided that a circumferential speed ratio of the sheet feeding roller 51 to the separating roller 53 is set as is, the following formula is given.

$$Vs=Vf\times is$$

According to Formula 6, $$Ns=Vf\times is/Rs \quad \text{(Formula 7)}$$

Here, provided that a decelerating ratio of the transmitting means of the separating roller 53 with respect to the sheet feeding roller 51 is it, the following formula is given in accordance with Formula 5 and Formula 7.

$$\begin{aligned} it &= Ns/Nf \quad \text{(Formula 8)} \\ &= (Vf\times is/Rs)/(Vf/Rf) \\ &= is\times Rf/Rs \end{aligned}$$

Accordingly, a load torque Tp given to the sheet feeding roller 51 from the torque limiter 62 is given by the following formula.

$$Tp=T\times it=T\times is\times Rf/Rs \quad \text{(Formula 9)}$$

A Fp required for rotating the sheet feeding roller 51 is represented by dividing a load torque by radius of the roller (multiplying a load torque by 1/radius of the roller), so, in accordance with Formula 9, $$\begin{aligned} Fp &= Tp/Rf \quad \text{(Formula 10)} \\ &= (T\times is\times Rf/Rs)/Rf \\ &= T\times is/Rs \end{aligned}$$

Consequently, a force F required for drawing the sheet S to the direction of the downstream side in the conveying direction from the nip between the sheet feeding roller 51 and the separating roller 53 is given by the following formula.

$$F=Fs+Fp=(T/Rs)+(T\times is/Rs)=(T/Rs)\times(1+is) \quad \text{(Formula 11)}$$

A force F required for drawing the sheet has been described as above, and when, for example, a circumferential speed of the sheet feeding roller 51 is equal to that of the separating roller 53, that is, when a circumferential speed ratio is of the separating roller 53 with respect to the sheet feeding roller 51 is 1, a force F required for drawing out the sheet from the nip between the sheet feeding roller 51 and the separating roller 53 onto the downstream side in the conveying direction is given as follows in accordance with Formula 11.

$$F=(T/Rs)\times(1+is)=(T/Rs)\times 2$$

As a result, it is found out that the pair of draw rollers 55 is required to draw the sheet with a force twice as much as the force Fr required for the separating roller 53 to give to the sheet S for the separating operation.

Furthermore, in reality, loss of the connecting parts mechanically connected, a load of frictional sliding force or the like is included, so a force F required for drawing operation needs additionally around 1.2-time to 1.5-time force.

The setting of the circumferential speed of the separating roller 53 will be explained in detail hereinafter with reference to a table and a graph.

When the separating roller 53 separates the sheet, the restoring force given by the separating roller 53 to the sheet is normally generated by the circumferential speed; when the circumferential speed is lower, the restoring force yields to the conveying force of the upper surface of the sheet conveyed by the sheet feeding roller 51, thereby incapable of restoring the double-fed sheet; on the other hand, when the circumferential speed is higher, an effect of preventing the double-feed is higher, but the sheet might be returned to a position farther from the normal stacking position, and furthermore, as shown in Formula 11, the force F required for drawing the sheet in the conveying direction might be increased.

In this embodiment, it is set so that a set torque of the torque limiter 62 is 0.03236 N·m (330 gf·cm), a radius Rf of the sheet feeding roller 51 is 18 mm, a radius Rs of the separating roller 53 is 12 mm, and a conveying speed of the sheet is 120 mm/sec.

It is set so that a rubber part of the draw roller 55*a* is ϕ14, a width in a thrust direction of the draw roller 55*a* is 46 mm, and resin material of the draw roller 55*b* oppositely disposed thereto is ϕ12 and the pressure of the draw roller 55*b* with respect to the draw roller 55*a* is 9.8 N (1 kgf).

Further, a pressure of the separating roller 53 by the spring 73 with respect to the sheet feeding roller 51 is set to be 3.334 N (340 gf). Under these setting conditions, measuring results of a drawing force F (N) with respect to the circumferential speed ratio is of the sheet feeding roller 51 to the separating roller 53, a draw roller conveying speed (percentage (%) with respect to drawing force F of 0 (drawing force F=0)) and an anti-double-feeding ability will be shown in Table 1.

Although the drawing force F in Table 1 is a value given by Formula 11, but, the value becomes 1.2 to 1.5 times higher since, in reality, sliding resistance, losses or the like is added as mentioned above.

A draw roller conveying speed (%) represents a conveying speed by the draw rollers 55 when given the respective drawing force F, with respect to the conveying speed of the sheet by the draw roller pairs 55 when drawing force is 0. An appropriate position restoring ability represents an ability to restore a sheet to the appropriate position, when sheets having a variety of frictional coefficients are respectively fed.

Figure 8:
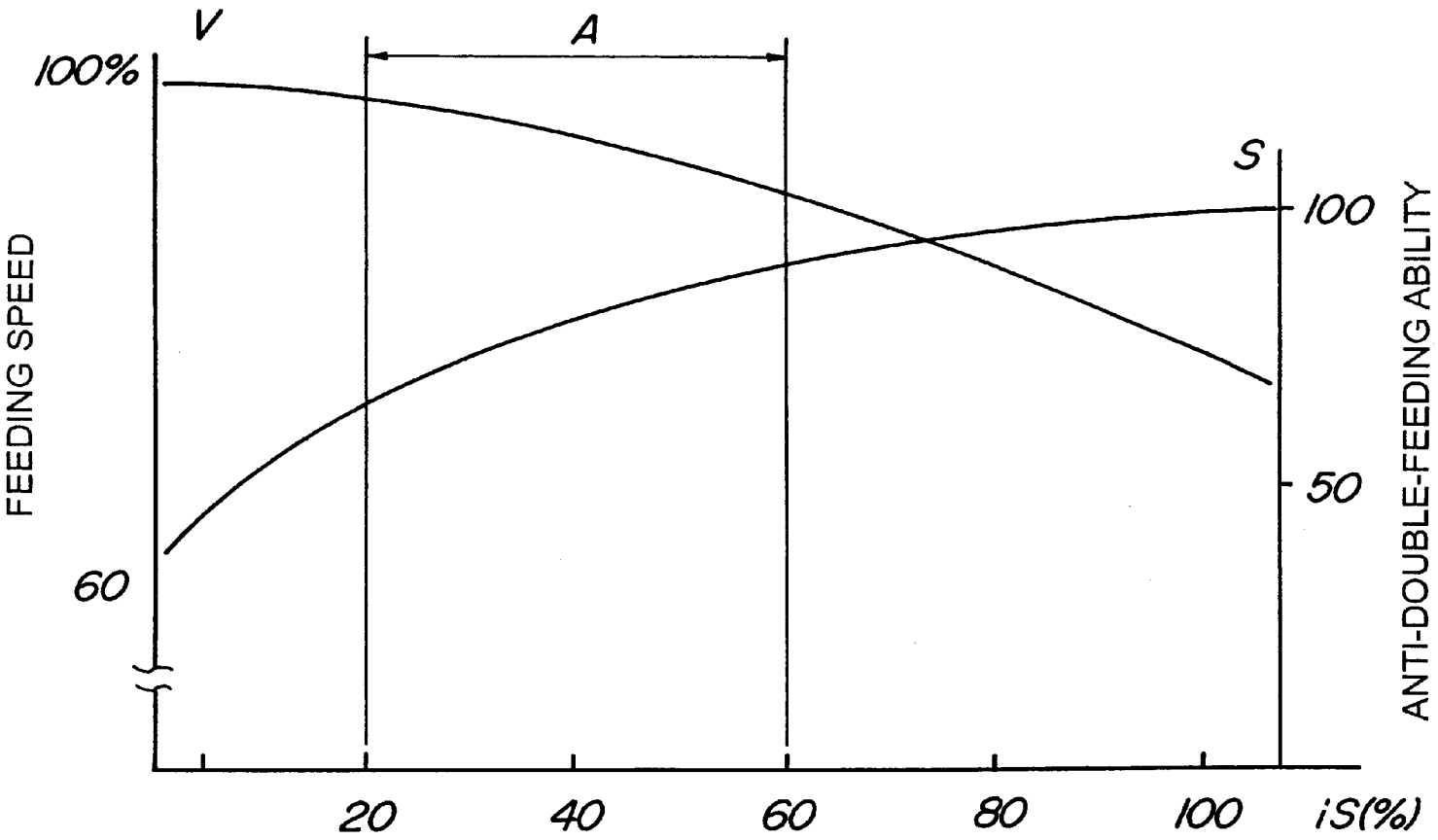
FIG. 8 is a correlative graph among anti-double feeding ability, feeding speed, and circumferential speed (is)

Based on Table 1, shown in FIG. 8 is a graph having, as an axis of ordinates, the anti-double-feeding ability and the conveying speed respectively, where the circumferential speed of the separating roller 53 is 100% with respect to the drawing roller 55*a,* and having, as an axis of abscissas, the circumferential ratio is of the separating roller 53 with respect to the sheet feeding roller 51. Line V and Line S respectively show the conveying speed and the anti-double-feeding ability.

As seen from the graph and the table, a favorable range where the double-feed is preventable and the sheet is not too much returned, as well as, the conveying speed is 90% or more without a problem for practical use is a range where the circumferential speed of the separating roller 53 is approximately 20% to 60% of that of the sheet feeding roller 51. In other words, both the good anti-double-feeding ability and the appropriate conveying speed are compatible in this range.

Incidentally, the data other than those about the appropriate position restoring ability in Table 1 are related to the material having high frictional coefficient, what is called ordinary papers, with respect to the rubber of the draw roller 55*a,* but in the case of special sheets having low frictional coefficient with respect to the rubber, decrease in the conveying speed under high load becomes more conspicuous.

As described above, by setting the circumferential speed of the separating roller 53 to be smaller with respect to the circumferential speed of the sheet feeding roller 51, more preferably, by setting the circumferential speed of the separating roller 53 to be around 20% to 60% of the circumferential speed of the sheet feeding roller 51, good sheet feeding and separating operations can be carried out without scarifying the anti-double-feeding ability and the conveying speed.

Furthermore, because the load when the pair of draw rollers 55 draw out the sheet can be reduced, the enduring ability of the pair of draw rollers 55 can be improved.

Incidentally, in a specific embodiment where a distance from the sheet feeding roller 51 and the separating roller 53 to the pair of draw rollers 55 is short, it is better to set the circumferential speed of the separating roller 53 to be a higher-side value (60% side) in the rage of around 20% to 60% of the circumferential speed of the sheet feeding roller 51.

This is because higher circumferential speed of the separating roller 53 can improve the separating ability. Thus, it can be prevented that the sheet double-fed at the time of separating operation by the separating roller 53 is not fully restored and then pinched between the pair of draw rollers 55.

On the contrary, in a case where a distance from the sheet feeding roller 51 and the separating roller 53 to the pair of draw rollers 55 is sufficiently long, the sheet thus fed is not drawn into the pair of draw rollers 55 while being double-fed, even if the circumferential speed of the separating roller 53 is not made higher, and therefore, the circumferential speed of the separating roller 53 can be set in a lower-side value (20% side) in the range of around 20% to 60% of the circumferential speed of the sheet feeding roller 51, thereby capable of improving abrasion resistance of the pair of draw rollers 55.

That is to say, in regard of improving the ability to restore the double-fed sheet to the appropriate position as well as the abrasion resistance of the pair of draw rollers 55, it is better to make the circumferential speed of the separating roller 53 as smaller as possible with respect to the circumferential speed of the sheet feeding roller 51; on the other hand, the separating ability to separate the double-fed sheet becomes worsen as the circumferential speed of the separating roller 53 becomes smaller. Consequently, suitable circumferential speed of the separating roller 53 is determined in accordance with a distance between the sheet feeding roller 51 and the pair of draw rollers 55, or a sheet feeding speed.

A structure in which the circumferential speed of the separating roller 53 is set to be 25% of the circumferential speed of the sheet feeding roller 51 will be described hereinafter.

Provided that, as mentioned above, a radius Rf of the sheet feeding roller 51 is 18 mm and a radius Rs of the separating roller 53 is 12 mm, the revolution number Ns of the separating roller shaft 54 is given as follows.

$$\begin{aligned} Ns &= (Nf \times Rf / Rs) \times 0.25 \\ &= (Nf \times 18/12) \times 0.25 \\ &= Nf \times 0.375 \end{aligned}$$

Consequently, it is only required that a gear ratio of the drive transmitting gear 57 to the separating roller gear 58 is set to be 3 to 8 (3/8).

With these set values, a force F required for drawing the sheet from the nip between the sheet feeding roller 51 and the separating roller 53 is calculated using Formula 11 with a torque value of the torque limiter of 0.03236 N·m (330 gf·cm).

$$F = (T/Rs) \times (1 + is)$$

$$= (0.03236/0.012) \times (1 + 0.375)$$

$$\approx 3.70792 \text{ N } (378.1 \text{ gf})$$

Although a value given by adding sliding resistance or the like to this value becomes an actual resistance applied to the pair of draw rollers 55, but, in the case where the rubber part of the draw roller 55*a* is made as ϕ14 with a width of 46 mm to provide driving force, and the roller 55*b* oppositely disposed is formed of resin material having ϕ12 to have the pressure of 9.8 N (1 kgf) against the roller 55*a,* a rate of decreasing the sheet conveying speed becomes 3% to 4%, and this level does not cause any significant problems in the feeding operation.

In addition, as for the weariness of the pair of draw rollers 55, the enduring test where 30000 sheets were conveyed was conducted to measure the decrease in the conveying speed before and after the enduring test; as a result the decrease rate is only around 1%, and this level also does not make any significant problems when the products are in practical use.

Thus, as mentioned above, by setting the circumferential speed of the separating roller 53 to be 25% of the sheet feeding roller 51, the double-fed sheet can be restored surely to the appropriate position while the separating ability is maintained, and also a decline in the enduring lifetime of the pair of draw rollers 55 due to the weariness can be suppressed.

Figure 13:
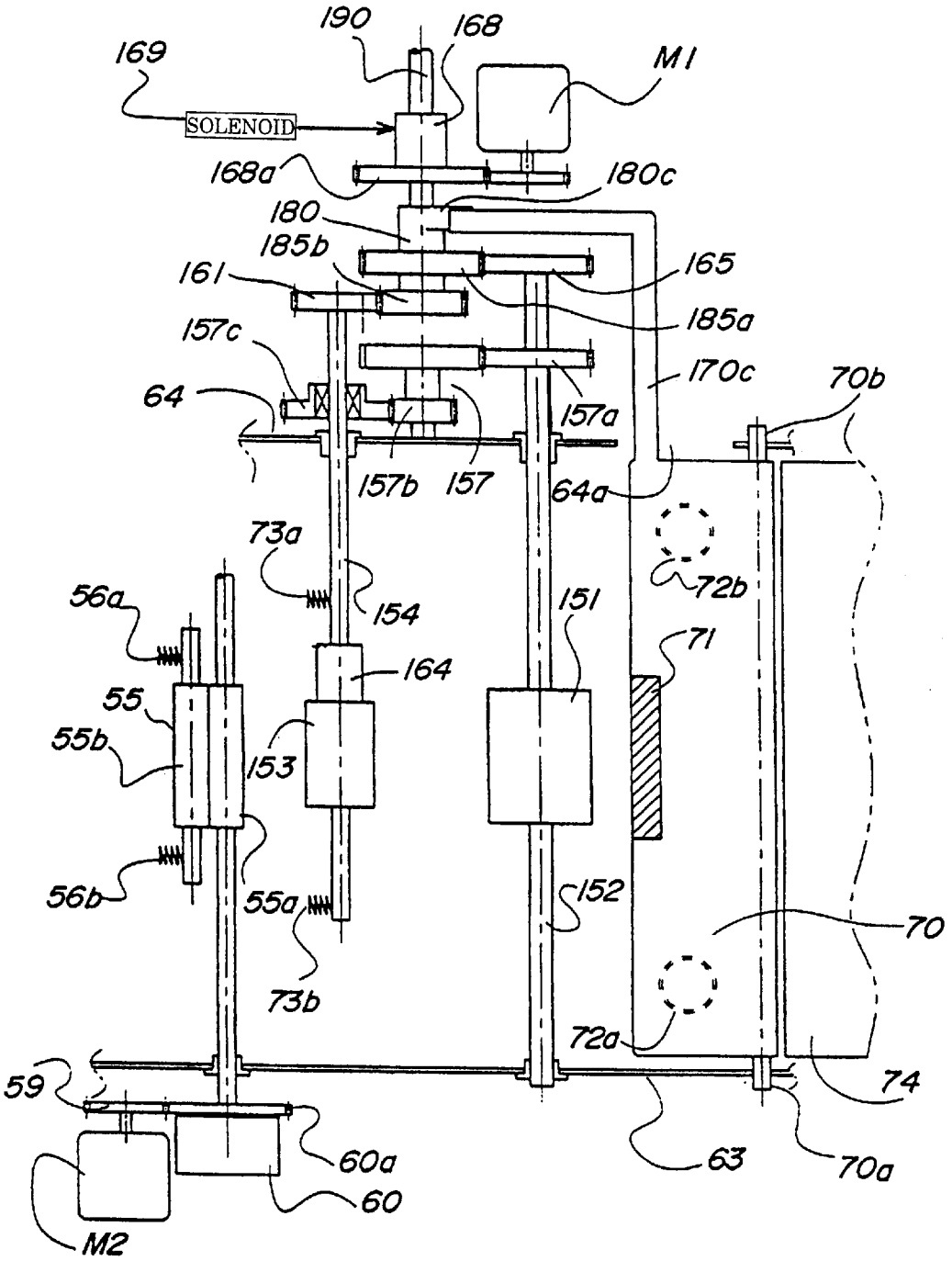
FIG. 13 is an expanded diagram for drive of the multiple feeding portion in the sheet feeding apparatus.

Incidentally, in this embodiment, the circumferential speed of the separating roller 53 is set to be 25%, but, as shown in the graph in FIG. 13, both the good sheet feeding operation and the abrasion resistance improvement of the pair of draw rollers 55 are compatible in the present invention as long as the circumferential speed ratio is in a range from 20% to 60%.

The sheet S drawn by the pair of draw rollers 55 from the nip between the sheet feeding roller 51 and the separating roller 53 is then conveyed toward a nip between the pair of registration rollers 81 disposed downstream, in the conveying direction, of the pair of draw rollers, the pair of registration rollers 81 stopping rotating.

The sheet detecting sensor 82 (see FIG. 2) constituted of photo-interrupter or the like is disposed on an upstream side of the pair of register rollers 81 in the sheet feeding direction, and when the leading end of the sheet S is detected (Step 4), by timer means (not shown) provided in the CPU 40 for counting a time corresponding to the distance between the sensor 82 and the pair of registration rollers 81, a signal for controlling the stop timing of the draw clutch 60 is issued so as to form a proper loop (state in FIG. 5(*h*)) between the pair of draw rollers 55 and the pair of registration rollers 81 (Step 6).

It is well known that this loop is formed as means for correcting skew-feed of the sheet S.

Further, by rotating the photosensitive drum 12 or the pair of registration rollers 81 by an image leading end synchronous signal issued from an optical apparatus or the like for exposing images, the sheet S is again conveyed onto the photosensitive drum 12, where toner images are transferred onto the surface.

Then, when a predetermined time T2 (sec) is elapsed after the trailing end of the sheet S passes through the sheet detecting sensor 82 to ascertain that the trailing end of the sheet S surely passes through the nip of the pair of registration rollers 81, a registration clutch 83 is turned OFF (Step 9, 10, 11). Incidentally, the sheet S to which the toner image has been transferred is sent to the fixing unit 22, where the image is fixed to the sheet, and then the sheet is delivered onto the delivery tray 25.

The same operations are repeated until the set number of the sheets is completed (Step 12), and after the set number of the sheets is completed, the draw clutch 60 is turned OFF (Step 13), and then the sheet feeding motor M1 and the draw motor M2 are respectively stopped (Step 14), and the whole procedure is ended.

In the embodiment of the present invention, as mentioned above, since the sheet S fed from the intermediate plate 70 is temporarily stopped and, also the pressingly contacting operation of the sheets on the intermediate plate 70 with the sheet feeding roller 51 is released, during which time, the restoring force of the separating roller 53 can operate, the sheet or sheets double-fed in the pre-feeding operation was able to be surely restored, thereby effecting high reliable sheet feeding.

In addition, by setting the circumferential speed of the separating roller 53 to be smaller with respect to the circumferential speed of the sheet feeding roller 51, preferably, by setting the circumferential speed of the separating roller 53 to be in a range from about 20% to 60% of that of the sheet feeding roller 51, the double-fed sheet was able to be prevented from being returned largely to a position with which the sheet feeding roller 51 cannot directly contact while the separating ability and the conveying speed were still satisfied, and furthermore, the load with respect to the pair of draw rollers 55 was able to be reduced, thereby improving the enduring lifetime of the pair of draw rollers 55.

Also, mechanically connecting the driving between the sheet feeding roller 51 and the separating roller 53 by utilizing the gears was able to simplify the structure and provide a further inexpensive apparatus.

In addition, by stopping the pre-fed sheet S temporarily, variance in the position of the leading end of the sheet S, when the sheets supported on the intermediate plate 70 are released from the pressingly contacting operation, can be minimized. Thus, the conveying distance from the position of the nip between the sheet feeding roller 51 and the separating roller 53 to the pair of draw rollers 55 can be shorten. Therefore, this can achieve miniaturization of the sheet feeding apparatus as a whole.

Next, a modified example of the embodiment according to the present invention will be described with reference to FIG. 9 and FIG. 10.

Figure 9:
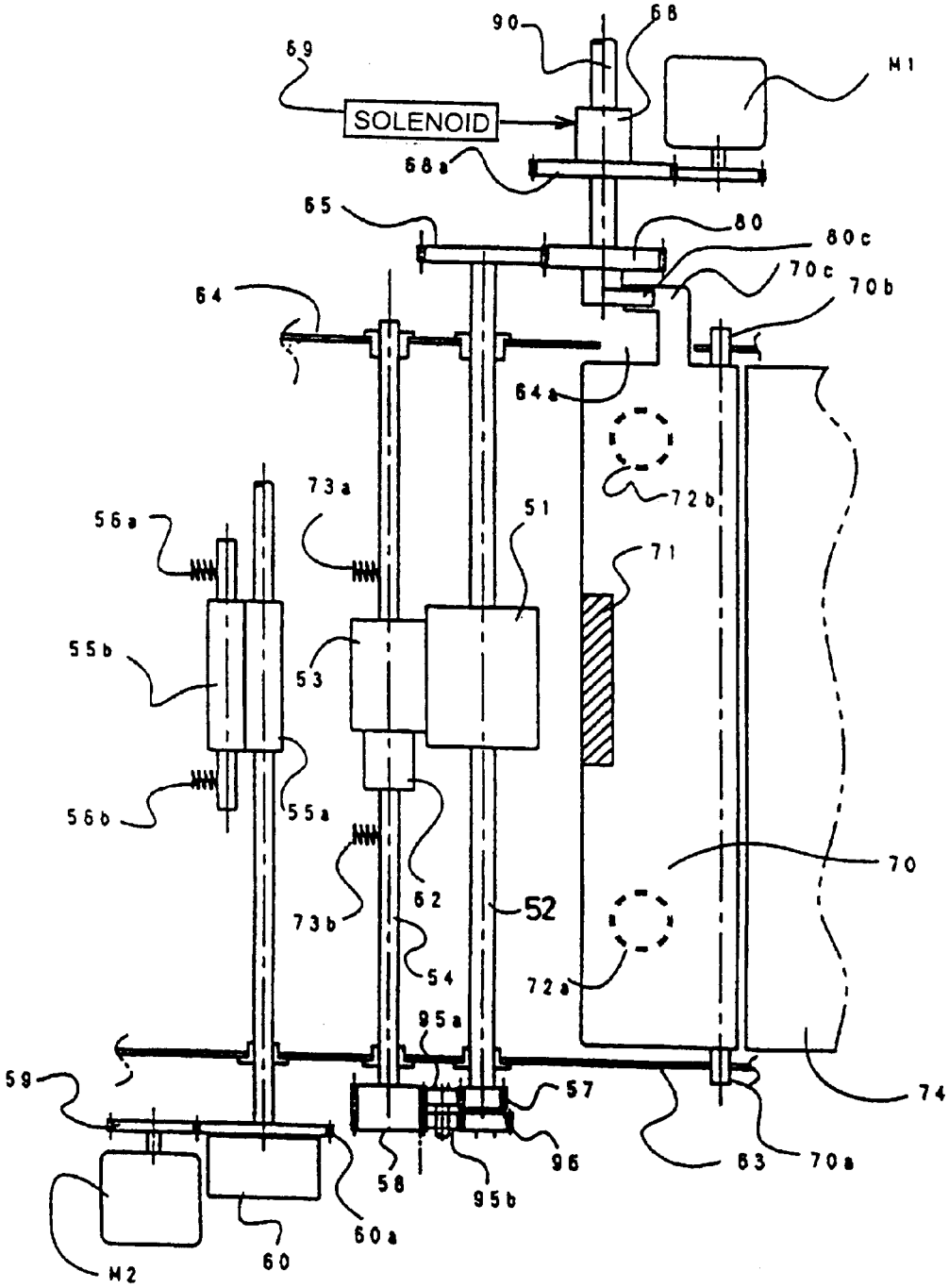
FIG. 9 is an expanded diagram for drive of the sheet feeding apparatus as a modified example of the embodiment.
Figure 10:
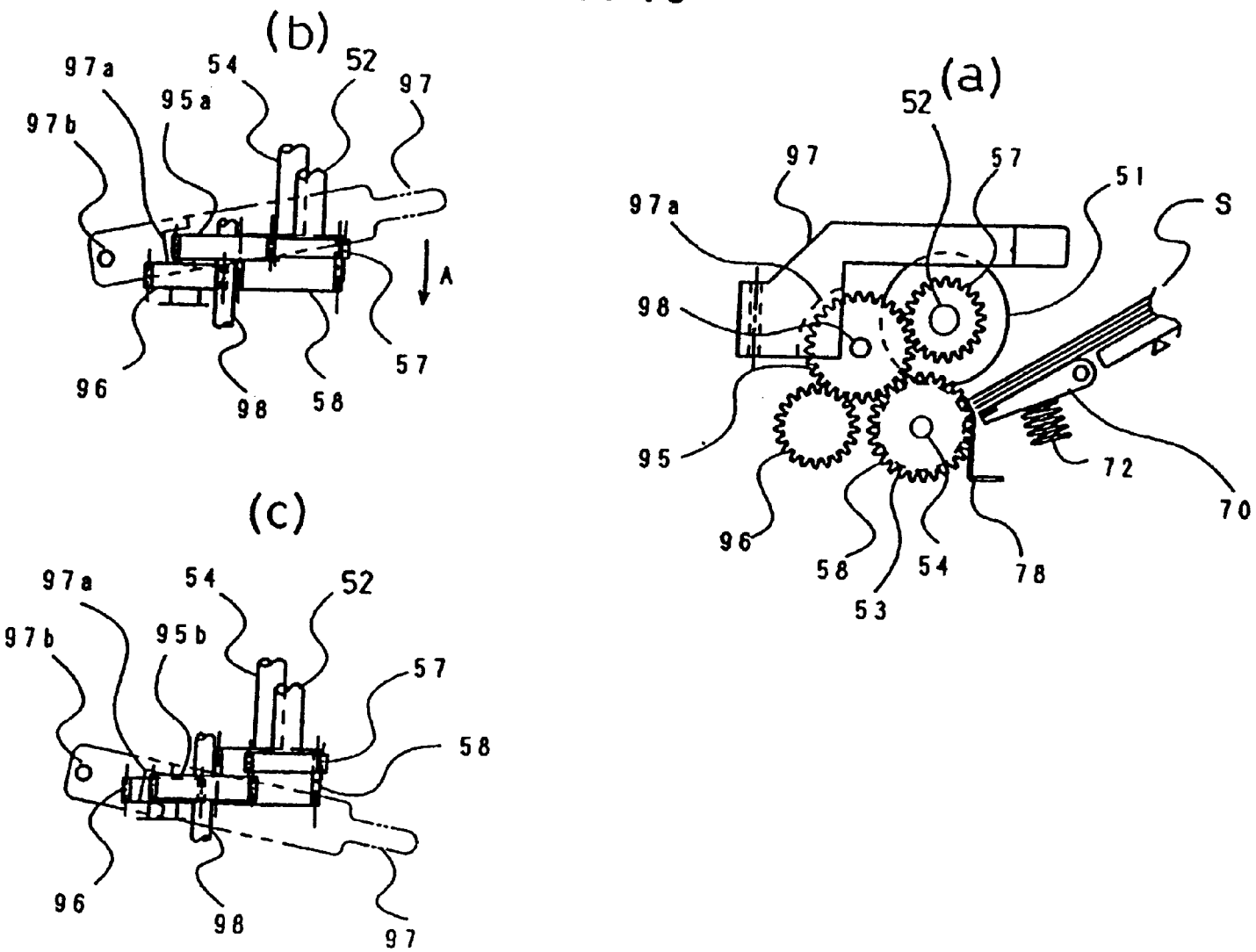
FIG. 10 is a cross section of an essential portion of the separating roller drive portion in the modified example and a top detailed view of the separating roller drive portion.

FIG. 9 is a drive development view of a manual sheet feeding apparatus of a modified example of the embodiment according to the present invention, and FIG. 10(*a*) is a cross-sectional view of an essential part showing a driving section of a separating roller in the manual sheet feeding apparatus, and FIGS. 10(*b*) and (*c*) are top detail drawings showing the driving section of the separating roller in the manual sheet feeding apparatus.

The modified example is so switchably structured between that the circumferential speed of the separating roller 53 is set to be smaller with respect to the circumferential speed of the sheet feeding roller 51 and that the separating roller shaft 54 is fixed not to be rotated. Incidentally, unspecified parts of the structure are the same as the embodiments mentioned above, and the members having the same functions are given the same numerals.

An idler gear 95 as a switching means for drivingly connecting between the separating roller shaft 54 and the sheet feeding roller shaft 52 is secured movably, along the shaft direction, on an idler shaft 98 secured to the main body, and the idler gear 95 is normally engaged with the separating roller gear 58.

A lever 97, as a switching means, provided with a fitting portion 97*a* for moving the idler gear 95 along the shaft direction, is so structured as to be capable of swinging on a center of rotation 97*b* as a center. By switching the lever 97, the idler gear 95 is moved on the idler shaft 98 for switching so as to be engaged with either drive transmitting gear 57 or rock gear 96 secured to the main body of the apparatus.

When engaged with the drive transmitting gear 57, the idler gear 95 becomes in a state of 95*a* shown in FIG. 9, FIG. 10(*b*), thereby working in the same way as that in the above-mentioned embodiment; when engaged with the rock gear 96, the idler gear 95 becomes in a state of 95*b* shown in FIG. 9, FIG. 10*c,* thereby fixing the separating roller shaft 54.

When such a sheet as having a strong elasticity and a large conveying resistance such as a paperboard, and also as having a high separating property is utilized, the lever 97 is moved, by operation of a user or an electrical signal, in a direction indicated by arrow A in FIG. 10(*b*) to be in a state in FIG. 10(*c*), with the result that the idler gear 95 is engaged with the rock gear 96 to fix the separating roller shaft 54.

As a result, the sheet feeding roller 51 is released from the driving operation with the separating roller 53, thus to be in a free condition. As for a drawing force required in the separating portion, it is enough to have a force calculated by dividing a torque of the torque limiter by a radius of the separating roller (a torque of the torque limiter/a radius of the separating roller). Under the drawing condition as mentioned above, the force becomes:

$$F = 0.03235/0.012$$

$$= 2.696 \text{ N } (275 \text{ gf})$$

As mentioned above, the force required for the drawing operation becomes further small by fixing the separating roller shaft 54 with respect to a sheet having a good separating property and by releasing the sheet feeding roller 51 from the rotating force by the separating roller 53 (torque limiter 62).

Consequently, the conveying force required for the pair of draw rollers 55 becomes small even against such a sheet as having strong elasticity and large conveying resistance, for example, a paperboard, thereby achieving the stabilization of the conveying speed as well as the improvement of the endurance.

The aforementioned embodiment shows a sheet feeding apparatus of the retard separation type where a sheet is fed to a separating portion by pressing the intermediate plate 70 against the sheet feeding roller 51, but substantially the same advantages can be obtained by using a sheet feeding apparatus, as shown in FIG. 10, where a sheet is fed to the separating portion by a pick-up roller which can be separated from as well as contacted with the sheet.

Figure 11:
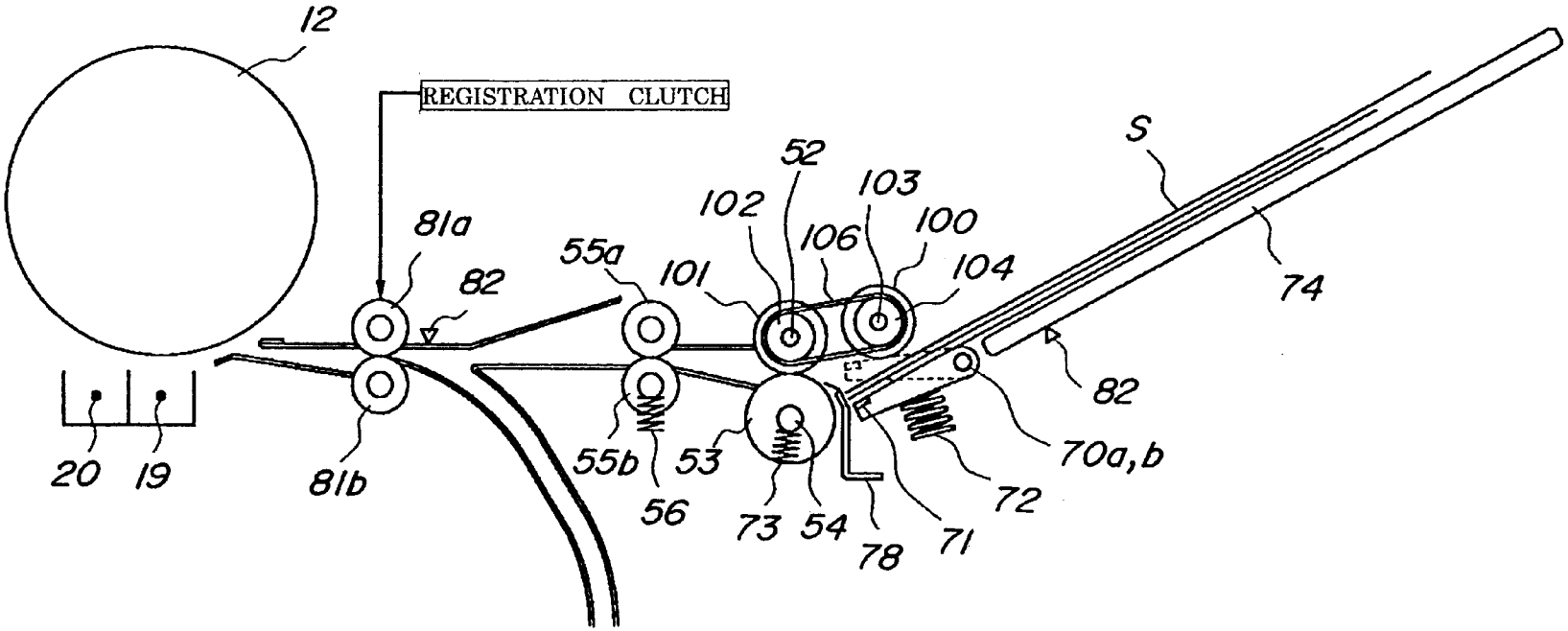
FIG. 11 is a cross section of an essential portion of a sheet feeding apparatus having a pickup roller.

The sheet feeding apparatus as shown in FIG. 11 is provided with a pick-up roller 100 as a sheet feeding means which is directly contacted with sheets supported on the an intermediate plate 74, and it is so structured that driving force is transferred between a sheet feeding roller 101, pulleys 102, 104 and a pulley belt 106.

Sheets fed out by the pick-up roller 100 are then fed to a separating portion formed by the sheet feeding roller 101 and the separating roller 53 where the sheets are separated sheet by sheet. Although not shown in figures, it is so structured, as the same in the aforementioned first embodiment, that the driving force of the sheet feeding roller 101 is transmitted to the separating roller by transmitting means.

Even in such a structure, substantially the same advantages as those in the aforementioned embodiment can be gained, by setting the circumferential speed of the separating roller 53 to be smaller than the circumferential speed of the sheet feeding roller 101, more preferably, in a range of about 20% to 60% of the circumferential speed of the sheet feeding roller 101.

Each of the embodiments where the circumferential speed of the separating roller 53 is set to be 25% of the circumferential speed of the sheet feeding roller 51 was explained, but, when there is an sufficient distance between the sheet feeding roller 51 and the pair of draw rollers 55, or when the apparatus needs extremely high separating ability, the circumferential speed of the separating roller 53 may be set to be higher. For example, when the circumferential speed of the separating roller 53 is set to be 50% of the circumferential speed of the sheet feeding roller 51, although the conveying speed of the pair of draw rollers 55 is declined by about 6% when compared with the case of no resistance, as shown in Table 1 and FIG. 8, the separating ability is improved, thereby making it possible to enhance greatly the reliability regarding the double-feed prevention.

Incidentally, in the aforementioned respective embodiments, the notched gear 80 is described so as to be formed integrally with gear portions and a cam portion, but those may be separately formed in order to adjust their phase angles.

Also, in the aforementioned respective embodiments, the notched gear 80 is described as having the two toothless portions, but the toothless portion 80*d,* for example, can be omitted. When the toothless portion 80*d* is omitted, the sheet S is not stopped temporarily in the pre-feeding operation, with the result that deviation in pressure releasing timing with respect to the conveying position of the sheet S occurs, depending on the number of stacked sheets. However, the intermediate plate 70 can carry out the estranging operation until the leading end of the sheet S reaches the pair of draw rollers 55, and therefore, the separating operation by the separating roller 53 is not be obstructed, thereby preventing the double-feed. In this case, as mentioned above, since the sheet is not temporarily stopped in the pre-feeding operation, the sheet feeding starting operation can be carried out at shorter intervals by just that much, and therefore it is very effective as a means for improving productivity.

In the aforementioned respective embodiments, controlling the fixed amount conveyance of the sheet feeding roller 51 is carried out by providing the notched gear 80 with the toothless portions, but the invention is not limited to this; other controlling means such as an electromagnetic clutch or the like may be used as long as they can control the fixed amount conveyance.

Further, in the aforementioned modified example, the engagement of gears is switched by a lever, thereby switching between the driving and the fixing of the separating roller shaft 54, but the switching operation between the driving and fixing may be carried out by utilizing other mechanical means such as a latch or the like, or an electromagnetic brake or the like.

Although, in each of the aforementioned embodiments, the examples where the present invention is applied to the multi-feeding section are raised for explanation, but it is, as a matter of course, applicable in a cassette feeding section or a deck sheet feeding section.

Furthermore, in each of the aforementioned embodiments, examples in which the sheet feeding apparatus is applied to the copying machine as the image forming apparatus are explained, but the present invention is not limited to this, and the present invention can be applied to an image reading apparatus, for reading images described on a sheet.

Subsequently, referring to FIGS. 12 to 18, a sheet feeding apparatus as another embodiment different from the above embodiment and an image forming apparatus are described. The image forming apparatus having the embodiment to be described is the same as the structure shown in FIG. 1*m* so that a general description of the apparatus is omitted.

Figure 12:
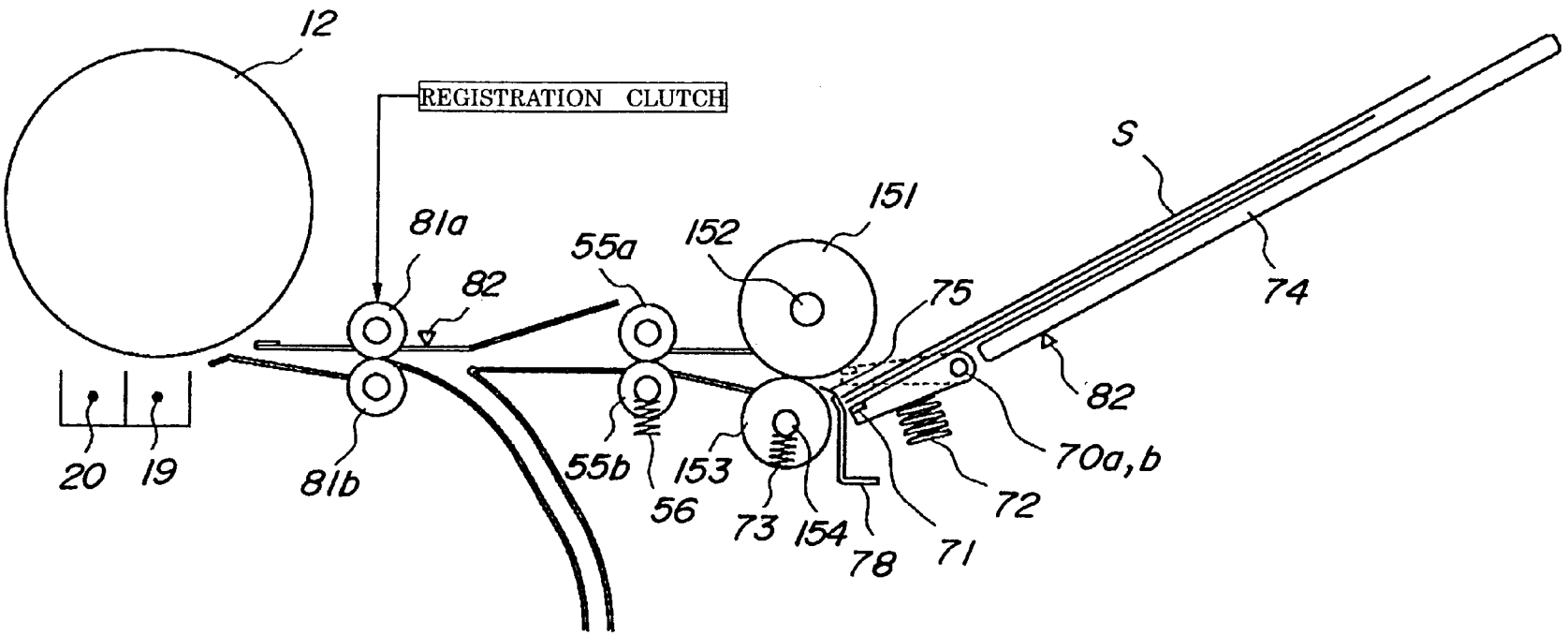
FIG. 12 is a cross section of a multiple feeding portion and a drum portion in a sheet feeding apparatus according to another embodiment of the invention.

As shown in FIGS. 12, 13, a sheet feeding roller 151 is secured to a feeding roller shaft 152, and the feeding roller shaft 152 is rotatably supported to a front side plate 63 and a rear side plate 64. A sheet feeding driving gear 165 as a first transmitting means and a feeding transmitting gear 157*a* as a third transmitting gear are supported at an rear side end of the feeding roller shaft 152.

The feeding roller shaft 152 and a separating roller shaft 154 are connected so that the drive can be transmitted by a separating transmitting gear 157*c* held at the separating roller shaft 154 via the feeding transmitting gear 157*a,* an idler gear 157*b* serving as the third transmitting means, and a one-way clutch 158 (the third transmitting means is constituted of those three gears, and hereinafter the three gears are referred to as transmitting gear 157 collectively.).

When the feeding roller shaft 152 rotates in the sheet feeding direction, the separating roller shaft 154 rotates by the transmitting gear 157 in a direction opposite to the sheet feeding direction (i.e., a direction returning the sheet) upon receiving the rotation of the feeding roller shaft 152). Where the feeding roller shaft 152 rotates in the direction opposite to the sheet feeding direction, the one-way clutch 158 placed between the gear 157*c* and the separating roller shaft 154 operates idling, so that no drive force is transmitted to the separating roller shaft 154.

With respect to the drive force transmission by the transmitting gear 157, the reduction speed ratio by the respective gears of the transmitting gear 157 is set so that the separating roller 153 rotates at a circumferential speed one fourth of the circumferential speed of the sheet feeding roller 151. The settings of the circumferential speeds are described below in detail.

A torque limiter 162 is formed between the separating roller shaft 154 and the separating roller 153 to provide a prescribed torque to the separating roller 153, and the separating roller 153 is structured to rotate via the torque limiter 162.

The separating roller 153 is formed to face to the sheet feeding roller 151 and structured to press the sheet feeding roller 151 with predetermined pressure by springs 73 (73*a,* 73*b*) formed with bearings, not shown.

During feeding operation, the separating roller shaft 154 inputs drive so that the separating roller 153 rotates in the direction opposite to the sheet feeding direction. Torque value of the torque limiter and pressures of the pressing springs 73*a,* 73*b* of the separating roller 153 are selected, in a state that only one sheet exists at a nipping portion formed between the sheet feeding roller 151 and the separating roller 153 or no sheet exists, so as to render the separating roller 153 follow to the sheet feeding roller 151 by frictional force (or stops while the sheet feeding roller 151 stops) and, in a state that two or more sheets exist at the nipping portion, so as to render the separating roller 153 rotate reversely to generate sheet restoring force.

A first notched gear 185*a* constituting the first transmitting means having two toothless portions 180*a,* 180*b* capable of meshing with the sheet feeding driving gear 165 is supported to a driving shaft 190 constituting the driving means at a position facing to the sheet feeding driving gear 165 supported to the feeding roller shaft 152.

Similarly, a second notched gear 185*b* constituting the second transmitting means having two toothless portions, not shown, capable of meshing with the separating driving gear 161 is supported to the driving shaft 190 at a position facing to the separating driving gear 161 serving as the second transmitting means supported to the separating roller shaft 154. Therefore, the first notched gear 185*a* and the second notched gear 185*b* form a rotation controlling portion 180.

A cam portion 180*c* is also formed at the rotation controlling portion 180 to engage and disengage the pressurized contact of an intermediate plate 70 with respect to the sheet feeding roller 151. A cam follower portion 170*c* is formed unitedly with the intermediate plate 70 on the rear side of the intermediate plate 70 and extends to a contact portion facing to the cam portion 180*c* by penetrating a hole 64*a* formed in a rear side plate 64, thereby being in contact with the cam 180*c*. This limits rotation of the intermediate plate 70 in the clockwise direction in FIG. 12.

The rotation controlling portion 180 is secured to the driving shaft 190 formed with a spring clutch 168. The spring clutch 168 receives drive force from a feeding motor M1 and rotates one turn by turning on the solenoid 169 for T1 (sec) for operating the spring clutch 168. Accordingly, at an initial state, the phase angles of respective members are selected so that the toothless portion 180*a* of the first notched gear 185*a* is placed to a position facing the sheet feeding driving gear 165 and so that the toothless portion of the second notched gear 185*b* is placed to a position facing the separating driving gear 161.

With this structure, in the initial state, the sheet feeding driving gear 165 and the separating driving gear 161 are free with respect to the rotation controlling portion 180, and the feeding roller shaft 152 and the sheet feeding roller 151 are able to rotate in either direction though rotation load of the torque limiter 162 is exerted.

It is to be noted that in this embodiment, the respective gear tooth numbers are set so that the circumferential speed V1 of the separating roller 153 driven by the second notched gear 185*b* satisfies, in respect to the circumferential speed Vf of the sheet feeding roller 151 by the first notched gear 185*a,* V1: Vf=1:1, approximately.

A drawing roller pair 55 as conveying means arranged on a downstream side of the sheet feeding roller 151 is constituted of a drawing drive roller 55*a* and a drawing driven roller 55*b,* and the drawing drive roller 55*a* is rotatively supported to the front and rear side plates63, 64 via bearings, not shown.

A drawing clutch 60 constituted of an electromagnetic clutch is formed at an end of the drawing drive roller 55, and the drive transmission from a drawing motor M2 is structured to be connected and disconnected via gears 59, 60*a*.

The drawing driven roller 55*b* is pressed by springs 56*a,* 56*b* via a bearing member, not shown, so as to face to the drawing drive roller 55*a*. Where the drawing clutch 60 is turned on, the drive of the drawing motor M2 is transmitted, and the drawing roller pair 55 rotate in the sheet feeding direction.

Next, structures of a transmitting means at the sheet feeding roller 151 and the intermediate plate 70 and a pressing and estranging means constituted of the cam portion 180*c* and the cam follower portion 170*c* are described in detail.

In the rotation controlling portion 180, as described above, the first notched gear 185*a* and the second notched gear 185*b,* and the cam portion 180*c* for pressing and releasing the intermediate plate 70 against the sheet feeding roller 151 are formed in a united body. The first notched gear 185*a* includes a first tooth portion 180*d* and a second tooth portion 180*e* in mesh with the sheet feeding driving gear 165 and two toothless portions 180*a,* 180*b* between the tooth portions.

The second notched gear 185*b,* in substantially the same way as the above, includes a third tooth portion and a fourth tooth portion, not shown, in mesh with the separating driving gear 161, two toothless portions between the tooth portions. The rotation controlling portion 180 is formed at the driving shaft 190 of the driving means as described above and can be driven for one turn by the spring clutch 168 and the solenoid 169. The structure of the spring clutch 168 does not relate to the nature of the invention, so a detailed description is omitted.

In the respective notched gears in the rotation controlling portion 180, the phase angle of the spring clutch 168, and shapes of the first toothless portion 180*a* and the third toothless portion are designed so that in the initial state, the first toothless portion 180*a* faces to the sheet feeding driving gear 165, and the third toothless portion faces to the separating driving gear 161. Therefore, the feeding roller shaft 152 and the separating roller shaft 154 are rotatable independently from one another because not meshing with the respective notched gears in the rotation controlling portion 180.

The phase relation of the respective gear tooth portions and the toothless portions of the second notched gear with respect to the separating driving gear 161 is structured equal to the phase relation of the respective tooth portions and the toothless portions of the first notched gear 185*a* with respect to the sheet feeding driving gear 165, and timings for operations of the sheet feeding roller 151 and the separating roller 153 are set to be in synchrony with each other.

The cam portion 180*c* is in contact with the cam follower portion 170*c* formed at the intermediate plate 70. The shape of the cam and the phase angle to the first toothless portion 180*a* are generally selected so that the intermediate plate 70 is spaced from the sheet feeding roller 151 in opposing to the pressing spring 72.

Therefore, when the user sets a sheet bundle, the intermediate plate 70 is spaced from the sheet feeding roller 151, so that the user can set the sheet bundle easily up to rendering the bundle contacting to a hitting plate 78.

Figure 14:
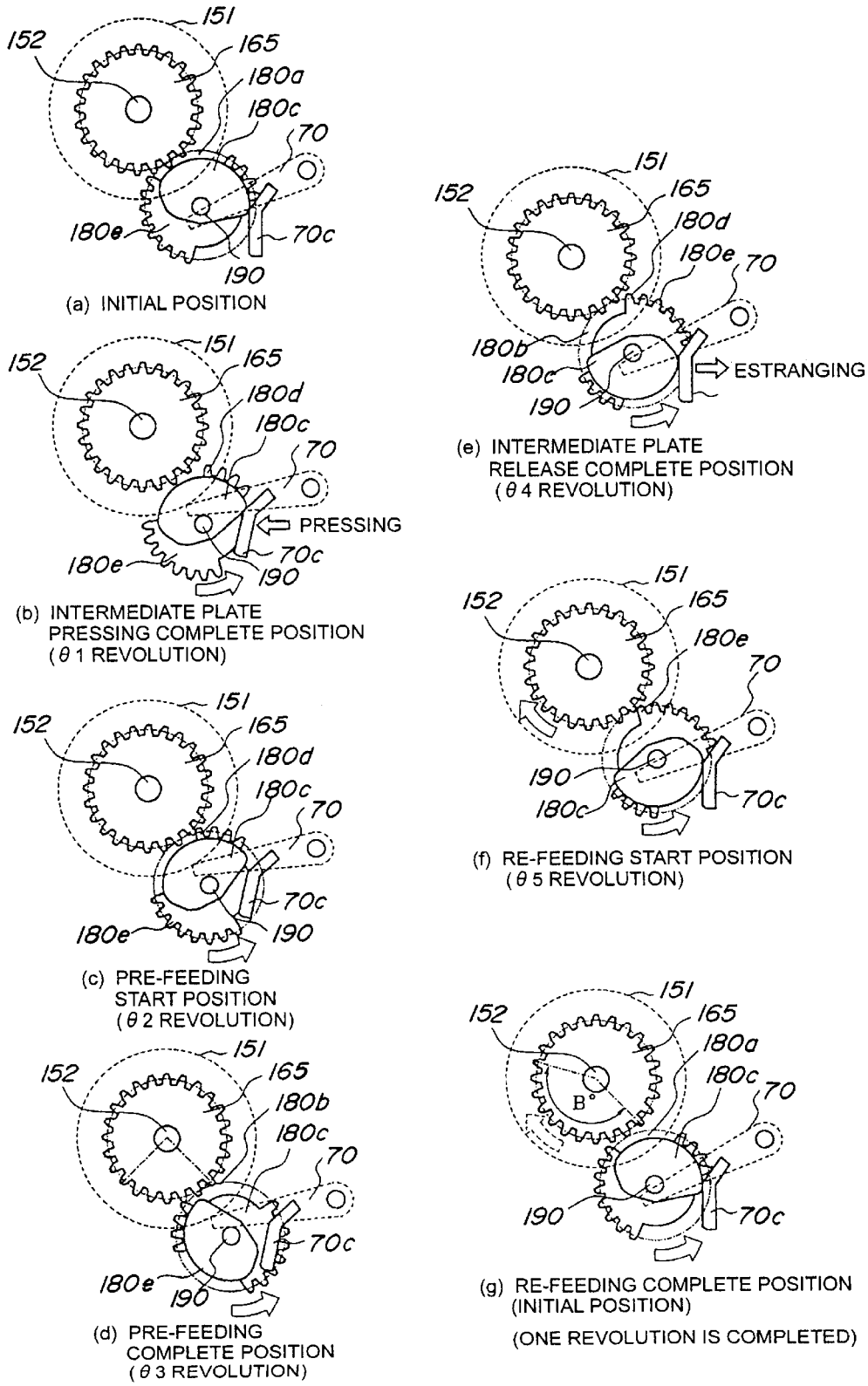
FIG. 14 is an illustration showing operation states of rotation controlling portion.
Figure 15:
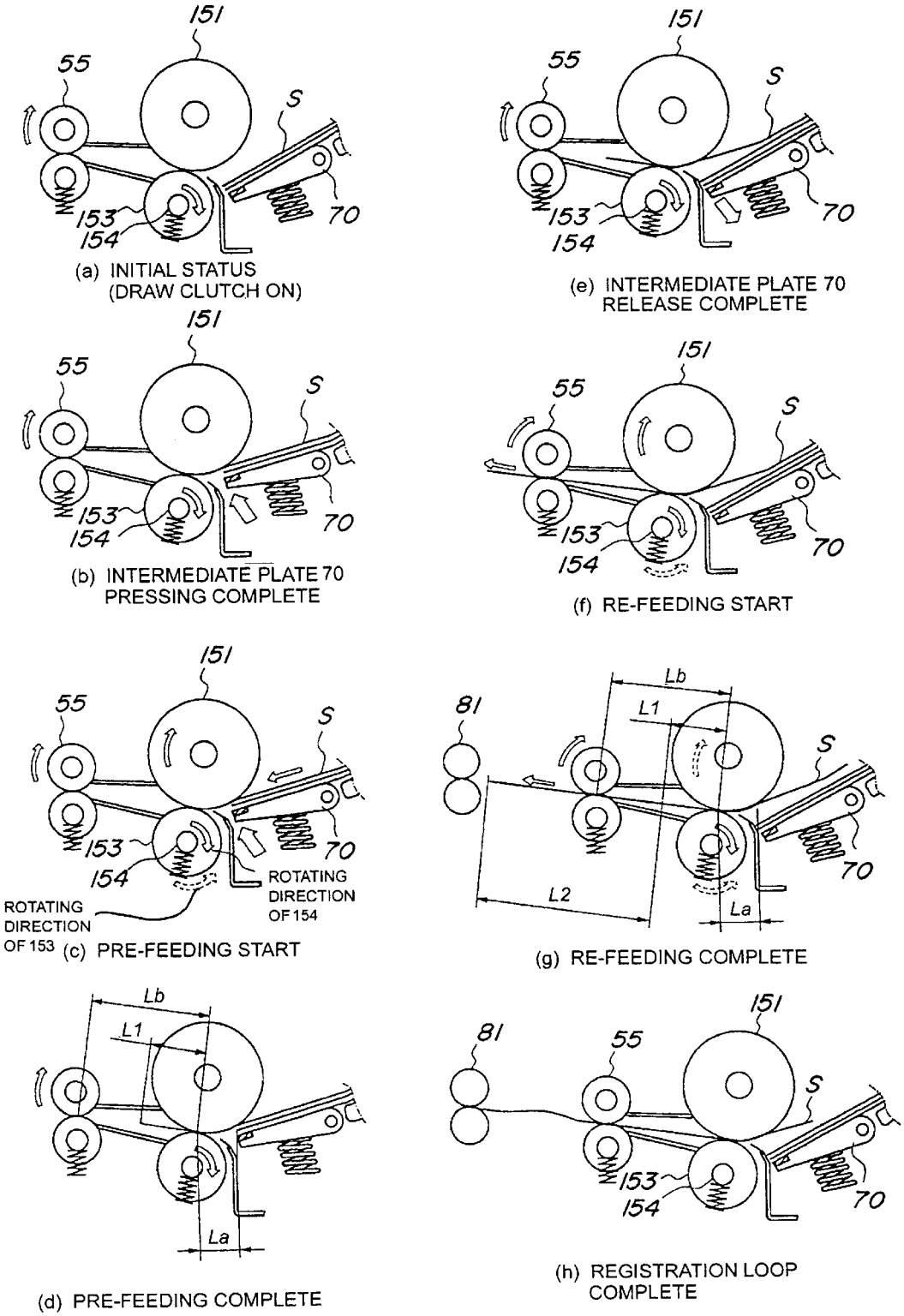
FIG. 15 is an illustration showing operation states of feeding portion.

Referring to FIGS. 14, 15, feeding and separating operation made by the transmitting means and the pressing and estranging means is described next.

When the solenoid 168 is turned on for T1 (sec), the rotation controlling portion 180 rotates for one turn as described above by operation of the spring clutch 168.

From rotation of the driving shaft 190, the rotation controlling portion 180 begins to rotate from the initial position (i.e., state shown in FIG. 14(*a*) and FIG. 15(*a*)) in the counterclockwise direction in FIG. 14, and the cam portion 180*c* for operating the intermediate plate 70 rotates from an intermediate plate estranged position to an intermediate plate pressing position θ1. According to this, the cam follower portion 170*c* of the intermediate plate 70 follows to render the intermediate plate 70 press the sheet feeding roller 151. Therefore, the topmost paper of the sheet bundle S stacked on the feeding tray 74 and the intermediate plate 70 comes in pressurized contact with the sheet feeding roller 151 (state in FIG. 14(*b*), FIG. 15(*b*)).

When the rotation controlling portion 180 rotates up to a position θ2, the first tooth portion 180*d* formed at the first notched gear 185*a* is engaged with the sheet feeding driving gear 165, thereby rotating the feeding driving gear 165 only by a predetermined angle A°. According to this rotation, the sheet feeding roller 151 rotates by angle A°, and the sheet S at the topmost portion of the sheet bundle is fed by a predetermined amount L1 (hereinafter, feeding operation up to this is referred to as "pre-feeding operation")(state in FIG. 14(*c*)(*d*), and FIG. 15(*c*)(*d*)).

Provided that an outer diameter of the sheet feeding roller 151 is D, a feeding amount L1 in the pre-feeding operation is represented by the following formula:

$$L1 = A° \times \pi \times D/360° \quad \text{(Formula A)}$$

Incidentally, the number of teeth of the first tooth portion 180*d* is selected so that the sheet feeding amount L1 during the pre-feeding becomes larger than a distance La from the sheet hitting plate 78 to the nip formed by the sheet feeding roller 151 and the separating roller 153 as well as smaller than a distance Lb from the nip position to the pair of draw rollers 55.

Due to this, the leading end of the sheet S thus pre-fed can be surely stopped at a position between the position of the nip portion and the nip position of the pair of the draw rollers 55.

Incidentally, the rotating speed of the sheet feeding motor M1 and the number of the teeth, the roller diameter or the like of the respective gears such as a transmitting gear 168*a* or the like are selected so that the rotating speed of the sheet feeding driving gear 165 is determined to make the sheet feeding speed of the sheet feeding roller 51 approximately equal to or a little slower than the feeding speed of the pair of draw rollers 55 or a pair of registration rollers 81.

Then, when the rotation controlling portion 180 is further rotated up to a position θ3 and the second toothless portion 180*b* reaches the position to which the sheet feeding driving gear 165 is opposed for engagement (state in FIG. 14(*d*), FIG. 15(*d*)), the driving force is not transmitted to the sheet feeding driving gear 165, thereby stopping the sheet feeding roller 151 temporarily.

Incidentally, since the number of teeth of the first tooth portion 180*d* is selected in a way as mentioned above, regardless of the sheet feeding starting position of the sheet S, the leading end of the sheet fed by the amount L1 in the pre-feeding operation can surely be stopped temporarily between the nipping portion between the sheet feeding roller 151 and the separating roller 153 the and the pair of draw rollers 55.

Thereafter, when the rotation controlling portion 180 is further rotated up to a position θ4 to return the cam portion 180*c* to the intermediate plate estranging position, the cam portion 180 comes in contact with the cam follower 170*c,* so that the intermediate plate 70 is disengaged from pressing against the sheet feeding roller 151 (state in FIG. 14(*e*) and FIG. 15(*e*)).

When the rotation controlling position 180 is further rotated up to a position θ5, the second tooth portion 180*e* of the first notched gear 185*a* is engaged with the sheet feeding driving gear 165 (state in FIG. 14(*f*) and FIG. 15(*f*)), and this movement resumes the rotation of the sheet feeding driving gear 165, and then the sheet feeding driving gear 165 is rotated only through a predetermined angle B°. Accompanied by this rotation, the sheet feeding operation by the sheet feeding roller 151 is resumed (the sheet feeding operation after pre-feeding operation is referred to as "re-feeding" hereinafter). The feeding amount L2 by the sheet feeding roller 151 at this time becomes $$L2=B^{\circ}\times\pi\times D/360^{\circ} \quad \text{(Formula B)}$$

The number of teeth of the second portion 180*e* is selected so that the feeding amount L2 in the re-feeding operation becomes an amount which can surely bring the leading end of the sheet fed in front of the pair of draw rollers 55 in the pre-feeding operation at least to the pair of draw rollers 55, but does not bring the leading end of the sheet to the pair of registration rollers 81.

Then, the rotation of the rotation controlling portion 180 is further advanced, and when the first toothless portion 180*a* reaches the position to which the sheet feeding driving gear 165 is opposed, the sheet feeding driving gear 165 does not receive the driving force, thereby stopping the rotation of the sheet feeding roller 151.

Then, the rotation controlling portion 1 80, after finishing one revolution, is stopped at the initial position (state in FIG. 14(*g*) and FIG. 15(*g*)).

As described above, the phase of the rotation controlling portion 180 is structured so that the drive of the separating roller 153 done by the second notched gear 185*b* is to rotate and stop in synchrony with the drive of the sheet feeding roller 151 done by the first notched gear 185*a,* so that the movement of the separating roller 153 is substantially the same as the movement of the sheet feeding roller 151 in terms of timing.

While the rotation controlling portion 180 rotates for one revolution, drive force is inputted to the separating roller shaft 154 from two portions, the second notched gear 185*b* of the rotation controlling portion 180, and the sheet feeding roller shaft 152 via the separating driving gear 161 and the transmitting gear 157, respectively.

Drive is inputted from the separating driving gear 161 to the separating roller shaft 154 so as to be the circumferential speed of the sheet feeding roller 151 as described above, but drive inputted from the sheet feeding roller shaft 152 via the transmitting gear 157 is structured so that the circumferential speed V2 of the separating roller 154 is set one fourth of the circumferential speed Vf of the sheet feeding roller 151.

Since the separating transmitting gear 157*c* is connected to the separating roller shaft 154 via the one-way clutch 158, the drive from the sheet feeding roller shaft 152 is cancelled by idling of the one-way clutch 158 while the separating driving gear 161 is in mesh with the second notched gear 185*b,* so that drive from the rotation controlling portion 180 has the priority.

Figure 16:
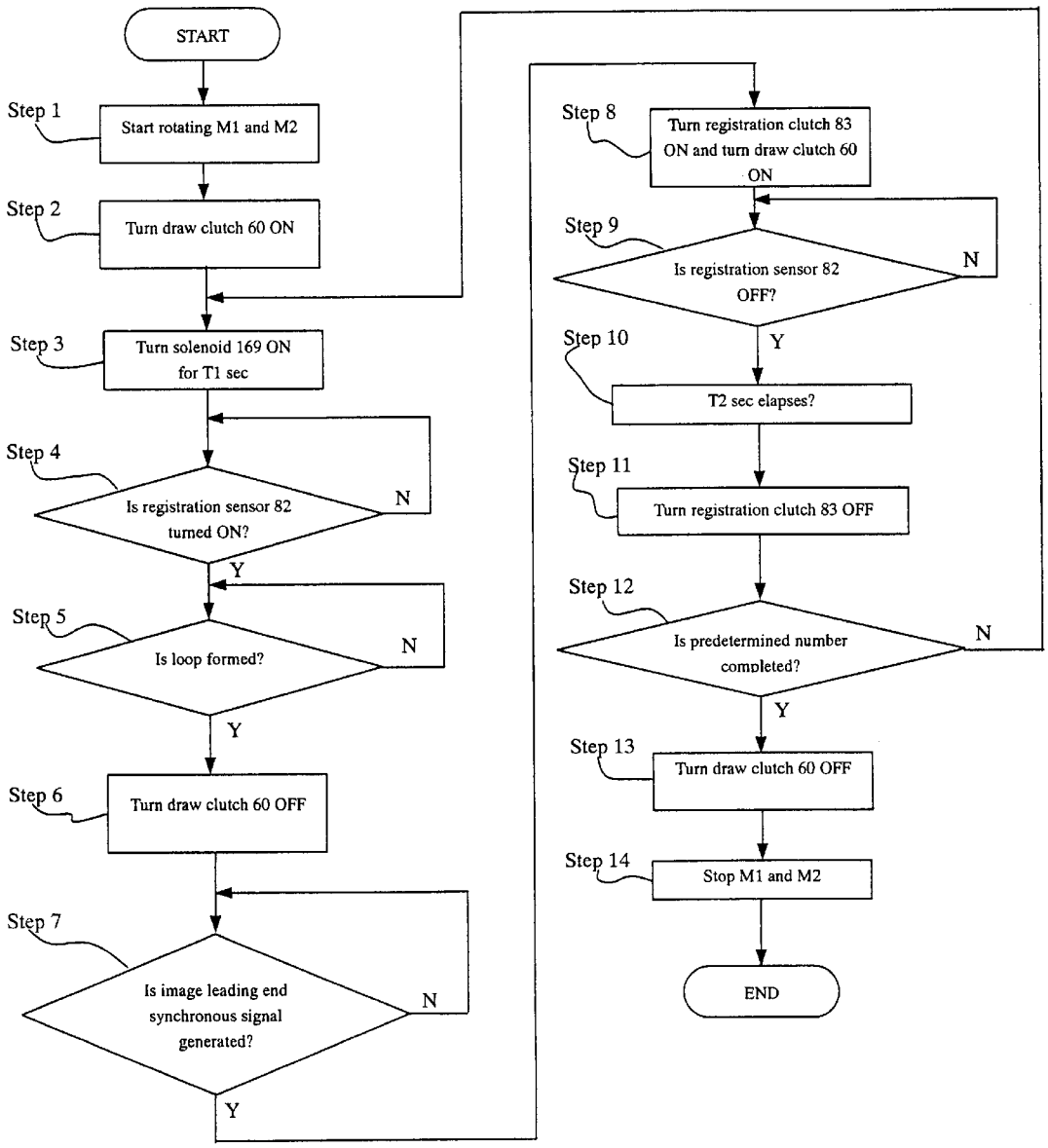
FIG. 16 is a flowchart at a time of feeding.
Figure 17:
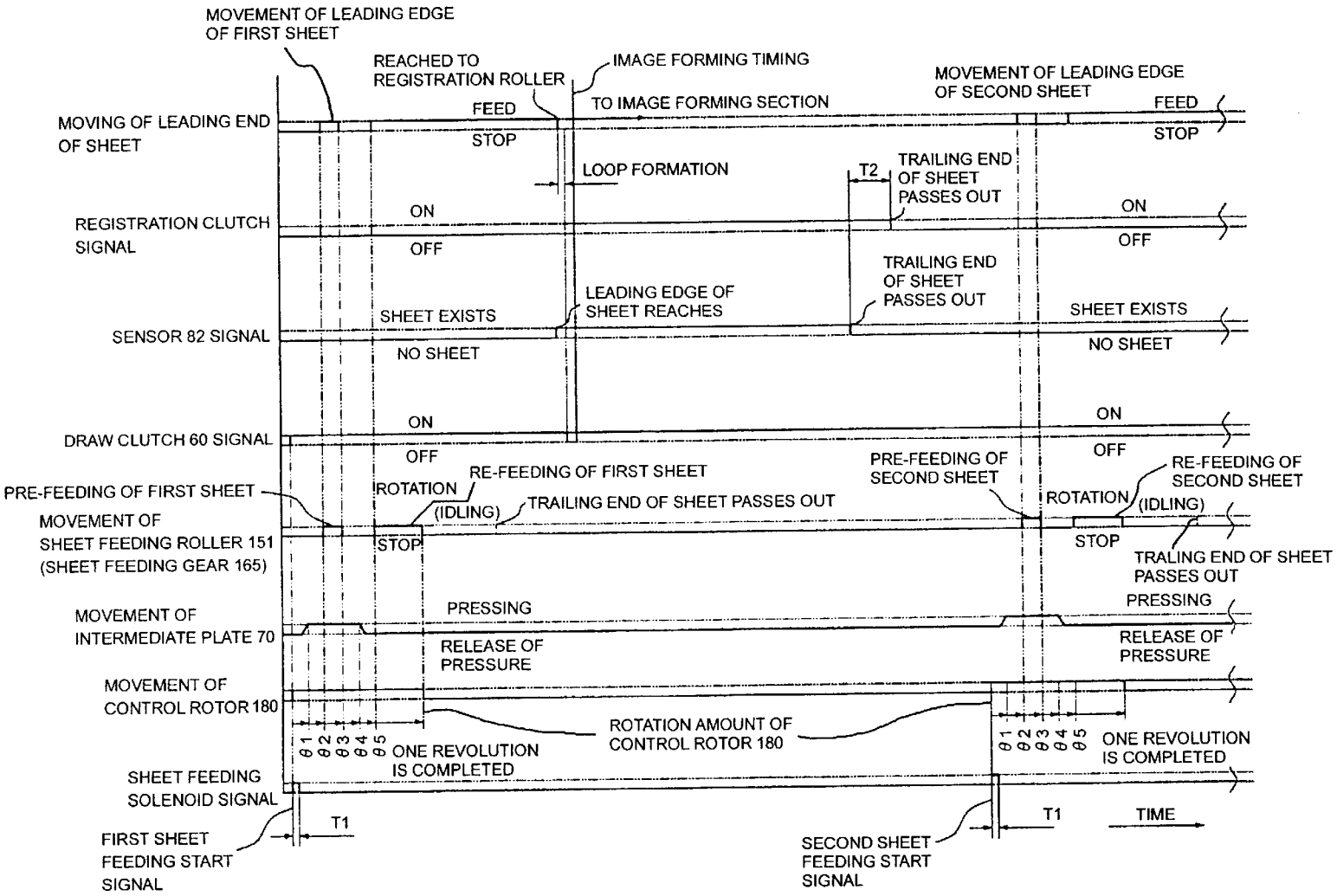
FIG. 17 is a timing chart at a time of feeding.

Next, the operation of sheet feeding from the multi-feeding section will be explained with reference to a flow-chart shown in FIG. 16 and a timing chart shown in FIG. 17.

In a state that the sheet bundle is stored on the sheet feeding tray 74, when a start button (not shown) is pressed, the draw motor M2and the sheet feeding motor M1 start to rotate respectively (step 1), and an ON signal of the draw clutch 60 is issued from a CPU 40 (see, FIG. 1) (step 2). As a result, the pair of draw rollers 55 start to rotate in the sheet conveying direction.

Next, after a predetermined time is elapsed, a signal from the CPU 40 turns ON the solenoid 169 by a time of T1 (sec) (Step 3) to start the control of one revolution of the rotation controlling portion 180. By this operation, first, the sheets supported by the intermediate plate 70 are made in pressurized contact with the sheet feeding roller 151.

Then, the sheet feeding roller 151 is rotated only through a predetermined angle A°, and the topmost sheet S stacked on the tray 74 is conveyed by a predetermined amount L1 by the pressure of the intermediate plate 70 and the friction force of the surface of the sheet feeding roller 151 (pre-feeding operation).

At this time, since the separating roller shaft 154 is synchronized with the sheet feeding roller shaft 52 to rotate in a direction opposite to the sheet conveying direction upon that the separating driving gear 161 comes in mesh with the second notched gear 185*b,* a predetermined restoring force is generated in the separating roller 153 by torque generated by the torque limiter 162.

Since the frictional force overcomes the restoring force before the sheet enters into the nip portion between the sheet feeding roller 151 and the separating roller 153, or when only single sheet is fed, the separating roller 153 is driven to rotate in the sheet feeding direction by following the rotation of the sheet feeding roller 151.

On the other hand, when two or more sheets are fed together in an overlapped state (what is called double-feed), the separating roller 153 tries to operate so as to return the double-fed sheets. At that time, however, since the intermediate plate 70 presses the sheet feeding roller 151 with the pressing spring 72, the separating operation by the separating roller 153 may be obstructed, with the result that the double-fed sheets may not be restored.

Therefore, when the rotation controlling portion 180 is further rotated to stop temporarily the sheet feeding roller 151, the intermediate plate 70 is estranged from the sheet feeding roller 151, by the operation of the cam portion 180*c* and the cam follower portion 170*c*. This releases the doubly fed sheets from the pressure of the intermediate plate 70, and therefore, the apparatus enters in a state that the sheets can be returned by the sheet feeding roller 151

The reason that the intermediate plate 70 is released from pressing upon a temporary stop of the feeding operation is that the pressure releasing timing may be shifted in association with the stacked number of the sheets S if the pressure release is made during the feeding operation since the up and down movement of the intermediate plate 70 is made by the cam portion 180*c,* so that the feeding operation may become unstable.

Where the rotation of the rotation controlling portion 180 is further advanced, the sheet feeding roller 151 begins re-feeding operation, and rotation in a direction opposite to the sheet conveyance direction is inputted to the separating roller 153. This resumes the conveyance of the sheets S that had ceased temporarily, and the doubly fed sheets are returned onto the feeding tray 74 by operation of the separating roller 153.

Where the leading end of the sheet S separated into one sheet is transferred to the pair of the drawing rollers 55, and after the sheet feeding roller 151 conveys the sheet by a predetermined amount Lb in the re-feeding operation, the rotation controlling portion 180 finishes one revolution to stop the drive transmission to the sheet feeding roller 151 and the separating roller 153, but the pair of draw rollers 55 continue to rotate, the sheet S is conveyed to the pair of registration rollers 81.

During this time, the first toothless portion 180*a* of the first notched gear 185*a* is disposed opposite to the sheet feeding driving gear 165, and the third toothless portion of the second notched gear 185*b* is disposed opposite to the separating driving gear 161, so that no drive is inputted into the sheet feeding roller 151. However, the sheet feeding roller 151 receives the conveyance force from the sheet S conveyed by the pair of draw rollers 55, with the result that the sheet feeding roller 151 is rotatively driven until a trailing end of sheet S passes through the nip portion between the sheet feeding roller 151 and the separating roller 153.

During this drawing operation, because the intermediate plate 70 is already estranged from the sheet feeding roller 151, a subsequent sheet S does not receive any frictional force from the sheet S thus drawn, so that any double feeding unlikely occurs. Even if the subsequent sheet is taken, rotation force generated by associated rotation of the sheet feeding roller 151 from the sheet feeding roller shaft 152 via the transmitting gear 157 is inputted to the separating roller shaft 154 during the rotation operation of the sheet feeding roller 151, so that the separating roller driving shaft 154 normally rotates in a direction opposite to the sheet conveyance direction.

Moreover, because the intermediate plate 70 is estranged upon release of pressing against the sheet feeding roller 151, the separating roller 153 starts reverse rotating by operation of the torque limiter 162 at that time, thereby pushing back the doubly fed sheets, so that double feeding is surely prevented.

Now, settings of the circumferential speed of the separating roller 153 by the respective notched gears and the circumferential speed by the transmitting gear 157 are described in detail. In this embodiment, until the fed sheets are conveyed by the pair of draw rollers 55, the respective notched gears transmit the drive force to the sheet feeding roller 151 and the separating roller 153. In this state, the circumferential speed ratio of the sheet feeding roller 151 and the separating roller 153 is about one to one.

After the sheets reach the pair of draw rollers 55, to prevent possible double feeding, the transmitting gear 157 is formed to transmit to the separating roller 153 the rotation force generated by the sheet feeding roller 151 rotating along with the sheet.

The transmitting gear 157 is designed so that the circumferential speed of the separating roller 153 is set approximately one fourth of the circumferential speed V1 where the rotation controlling portion 180 drives the separating roller 153 (hereinafter, the circumferential speed of the separating roller at that time is referred to as "circumferential speed after switching" and abbreviated as V2).

As set forth in the problems in the prior art, in the retard separating method, double feeding most likely occurs at a beginning stage of the feeding operation in which the fed sheets rush into the nipping portion between the sheet feeding roller 151 and the separating roller 153. When sheets are sent to the nipping portion, the sheet feeding pressure generated by pressurized contact between the sheet feeding roller 151 and the intermediate plate 70 is exerted to not only the topmost sheet but also sheets located below the top, so that multiple number of sheets rush into the nipping portion.

In other words, it is necessary to make sheet separating ability higher at the beginning stage of sheet feeding operation. Therefore, it is required to make higher the circumferential speed of the separating roller 153, and in this embodiment, the circumferential speed of the separating roller 153 is set substantially equal to the circumferential speed of the sheet feeding roller 151 in consideration of improvements in separating ability.

Where the sheet is separated sheet by sheet by the sheet feeding operation and where the sheet reaches the pair of draw rollers 55, the pair of draw rollers 55 has to pull out the sheet nipped at the nipping portion between the sheet feeding roller 151 and the separating roller 153 because the drive is not transmitted to the sheet feeding roller 151.

The pair of draw rollers 55 has to pull out the sheet in opposing to a torque directly given from the torque limiter 162 to the separating roller 153 in the direction opposite to the sheet conveyance direction and a torque indirectly given from the torque limiter 162 to the sheet feeding roller 151 through direct connection between the sheet feeding roller shaft 152 and the separating roller shaft 154 by way of the transmitting gear 157.

That is, as the drive transmitted to the separating roller shaft 154 by the transmitting gear 157 is larger, or in other words, as the circumferential speed of the separating roller 153 is larger, the indirect torque given to the sheet feeding roller 151 from the torque limiter 162 becomes larger.

For example, if the transmitting gear 157 has a gear ratio equalizing the circumferential speed Vf of the sheet feeding roller 151 and the circumferential speed V2 of the separating roller 153, the load received by the pair of draw rollers 55 in a direction opposite to the sheet conveyance direction is twice of the theoretical torque value of the torque limiter 62, and actually, the load may become larger due to mechanical loss and influences of frictional force.

After the sheet reaches the pair of draw rollers 55, the circumferential speed V2 after switching of the separating roller 153 is set about one fourth of that of the sheet feeding roller 151 in consideration of conveyance property of the pair of draw to rollers 55 or wearing prevention, etc.

This makes approximately one fourth the torque of the torque limiter 162 given as the load to the sheet feeding roller 151 rotating along with the sheet in comparison with the situation that the circumferential speed ratio Vf:V2 is one to one, thereby stabilizing the sheet conveyance of the pair of draw rollers 55.

If the circumferential speed of the separating roller 153 is made smaller, the separating ability may be reduced by that portion. However, if the sheet reaches the pair of draw rollers 55, the possibility that double feeding occurs becomes very low thereafter.

Particularly, in the case of the retard separating method in which the intermediate plate 70 is positionally shifted to render the sheet in contact with the sheet feeding roller 151 as shown in this embodiment, the intermediate plate 70 is estranged from the sheet feeding roller 151 after the sheet is surely nipped at the nipping portion, so that the second or higher sheets may not receive conveyance force.

Therefore, if the sheet is separated into a single sheet at the initial period of the feeding operation (i.e., before the sheet reaches the pair of draw rollers 55), the separating roller 153 is not necessarily rotated at such a high circumferential speed.

In other words, at the initial period of the feeding operation at which double feeding likely occurs otherwise, the drive transmitted to the separating roller 153 is made larger in consideration for the separation ability as the priority, and after the sheet is separated into a single sheet, the drive transmission is preferably set so that the circumferential speed of the separating roller 153 becomes lower in consideration for reduced load given to the pair of draw rollers 55 as the priority.

That is, as shown in this embodiment, by switching the circumferential speed of the separating roller 153 from V1 to V2 during the sheet feeding operation, sheet separating ability and prevention of worn-out of the pair of draw rollers 55 become compatible, so that the problems raised in the prior arts can be solved.

Although in this embodiment the separating roller shaft 154 is driven to render the circumferential speed smaller by the transmitting gear 157 after the sheet reaches the pair of draw rollers 55, the circumferential speed of the separating roller 153 can be switched before the sheet reaches the pair of draw rollers 55.

More specifically, if the toothless portion is formed so that the separating roller shaft 154 is made free before the sheet reaches the pair of draw rollers 55, the rotation of the sheet feeding roller 151 is transmitted to the separating roller shaft 154 via the transmitting gear 157, so that the circumferential speed can be switched.

In this embodiment, when the drive is transmitted by the respective notched gears, the circumferential speed Vf of the sheet feeding roller 151 and the circumferential speed V1 of the separating roller 153 are about the same, the gear ratio and the roller diameter are set so that the drive transmitted to the separating roller shaft 154 from the transmitting gear 157 makes the circumferential speed of the separating roller 153 (the circumferential speed after switching) one fourth of the circumferential speed V1 before switching, but this invention is not limited to those values.

That is, the circumferential speed V1 of the separating roller 153 at the initial period of the sheet feeding operation is not necessarily set substantially equal to the circumferential speed Vf of the sheet feeding roller 151, and there would be no problem as far as the sheet separating ability is satisfied. The circumferential speed V2 of the separating roller 153 after switching is set to be a value in consideration of compatibility of prevention of wearing of the pair of draw rollers 55 and sheet separating ability. However, if the sheet separation is not considered, the circumferential speed can be zero without transmitting any drive to the separating roller shaft 154. That is, if the circumferential speed V2 after switching of the separating roller satisfies the formula $0 \leqq V2 < V1$, such an apparatus can bring substantially the same advantages as the invention.

Where paper jamming occurs due to some cause or malfunction while a sheet is engaged with the nipping portion of the pair of draw rollers 55, the sheet feeding roller 151 can rotate in either direction freely because the toothless portion of the first notched gear 185*a* and the sheet feeding driving gear 165 are facing to each other. Therefore, the jammed sheets can be pulled in a direction opposite to the sheet conveyance direction, thereby making such jamming handling very easy.

This is accomplished because the means for operating the sheet feeding roller 151 is the gear having the toothless portion and because the drives of the sheet feeding roller 151 and the separating roller 153 are directly connected.

In other words, when the sheet feeding driving gear 165 and the first notched gear 185*a* are in mesh with each other, the sheet feeding roller 151 cannot rotate in a direction opposite to the sheet conveyance direction, and the drive in the direction opposite to the sheet conveyance direction is normally transmitted to the separating roller shaft 154 since the separating driving gear 161 and the second notched gear 185*b* are in mesh with each other. Therefore, the apparatus of the invention is not necessary to form a means for limiting rotation such as a one-way clutch formed at the sheet feeding roller shaft in some conventional arts.

Where the sheet feeding driving gear 165 and the first notched gear 185*a* are not in mesh with each other, the sheet feeding roller shaft 152 are freely rotatable, so that the shaft can rotate in the sheet conveyance direction as well as the reverse direction. Therefore, the sheets jammed can be pulled easily in the direction opposite to the sheet conveyance direction.

Where the sheet is pulled by the conveyance roller pair 55, the sheet feeding roller 151 rotates along with the sheet, and the rotation is transmitted via the transmitting gear 157 to the separating roller shaft 154, thereby making the separating roller shaft 154 normally rotate in a direction returning the sheets.

The leading end of the sheet S is conveyed toward a nipping portion between the pair of registration rollers 81 being stopped by the above operation. A sheet detecting sensor 82 as shown in FIG. 12 constituted of photo-interrupter or the like is disposed on an upstream side of the pair of register rollers 81, and when the leading end of the sheet S is detected (Step 4), by timer means (not shown) provided in the CPU 40 for counting a time corresponding to the distance between the sensor 82 and the pair of registration rollers 81, a signal for controlling the stop timing of the draw clutch 60 is issued so as to form a proper loop (state in FIG. 15(*h*)) between the pair of draw rollers 55 and the pair of registration rollers 81 (Step 6).

It is known that this loop is formed as means for correcting skew-feed of the sheet S.

Further, by rotating the photosensitive drum 112 or the pair of registration rollers 81 by an image leading end synchronous signal issued from an optical apparatus or the like for exposing images, the sheet S is again conveyed onto the photosensitive drum 112, where toner images are transferred onto the surface.

Then, when a predetermined time T2 (sec) is elapsed after the trailing end of the sheet S passes through the sheet detecting sensor 82 to ascertain that the trailing end of the sheet S surely passes through the nipping portion of the pair of registration rollers 81, a registration clutch 83 is turned OFF (Step 9, 10, 11). The sheet S to which the toner image has been transferred is sent to the fixing unit 22, where the image is fixed to the sheet, and then the sheet is delivered onto the delivery tray 25.

The same operations are repeated until the set number of the sheets is completed (Step 12), and after the set number of the sheets is completed, the draw clutch 60 is turned OFF (Step 13), and then the sheet feeding motor M1 and the draw motor M2 are respectively stopped (Step 14), and the whole procedure ends.

It is to be noted that in this embodiment, the intermediate plate 70 operates as pickup member for the sheets, but this invention is not limited to this structure, and the pickup structure made of a pickup roller is possible. As a specific embodiment, the cam portion 180*c* of the rotation controlling portion 180 may control the up and down movements of the pickup roller.

Alternatively, as shown in FIG. 11, the intermediate plate 70 may be structured movable, and the sheets are pressed to a stationary pickup roller and fed therefrom.

Figure 18:
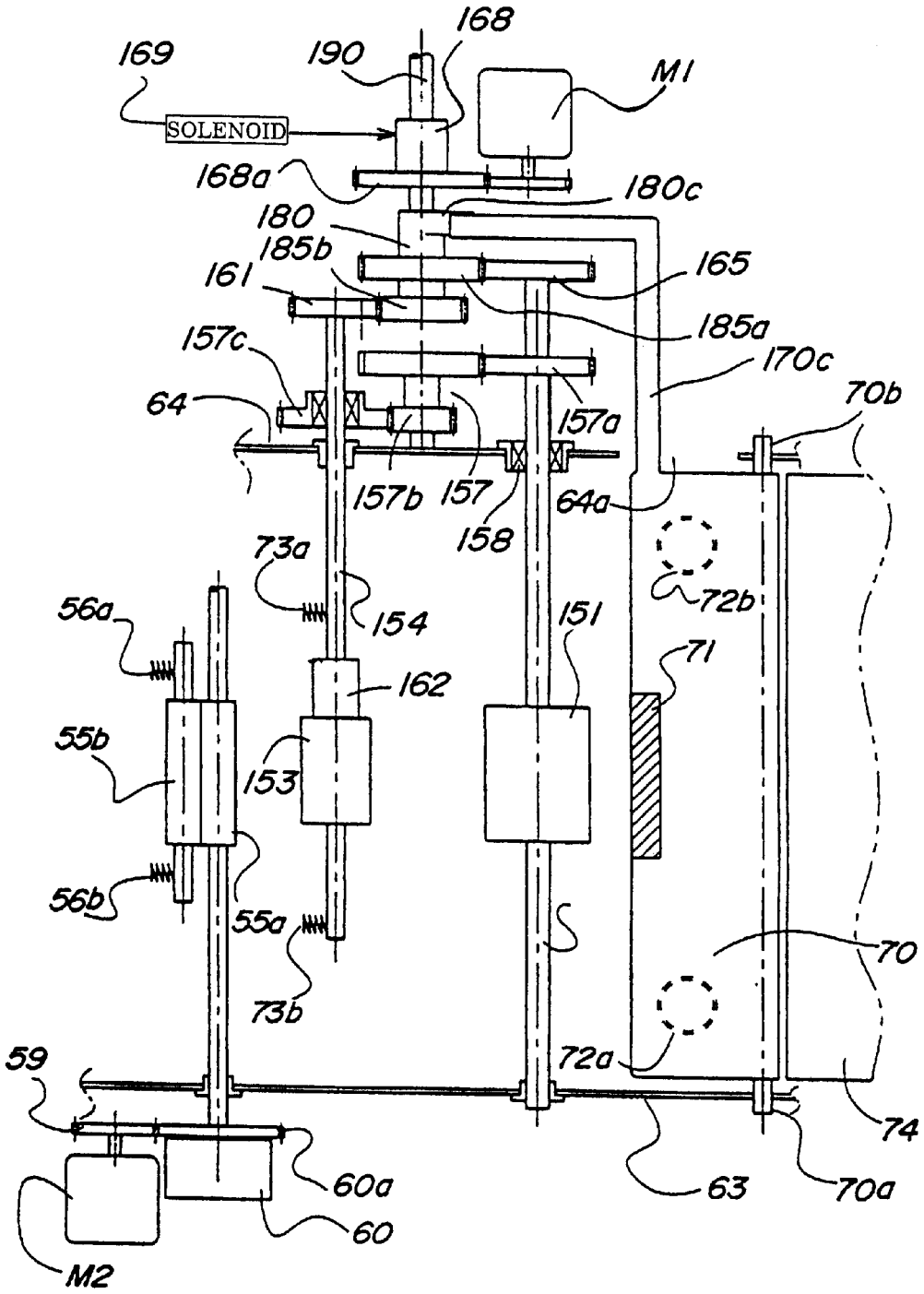
FIG. 18 is an expanded diagram for drive of the multiple feeding portion according to an embodiment in which an one-way clutch is formed at a feeding roller shaft.
Figure 19:
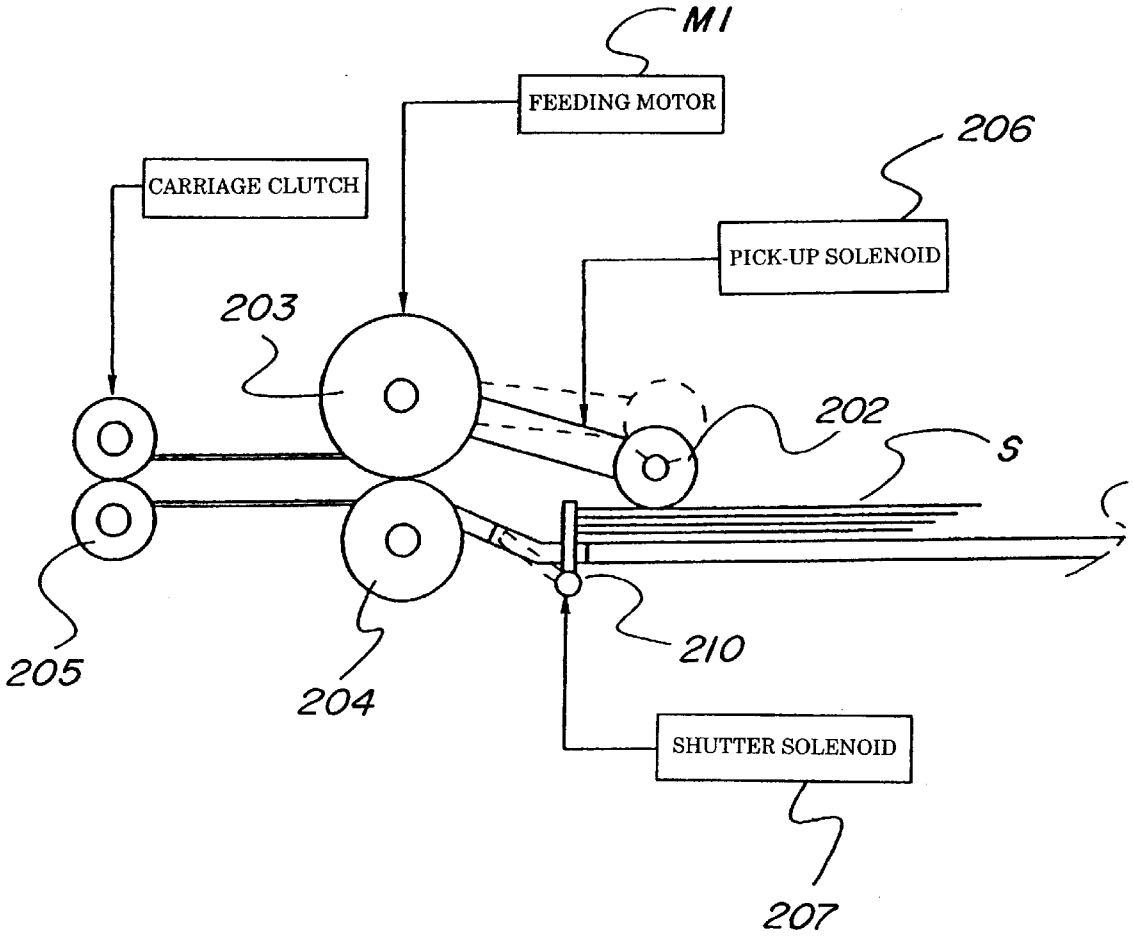
FIG. 19 (PRIOR ART)
FIG. 19 is a schematic side view of a first prior art.
Figure 20:
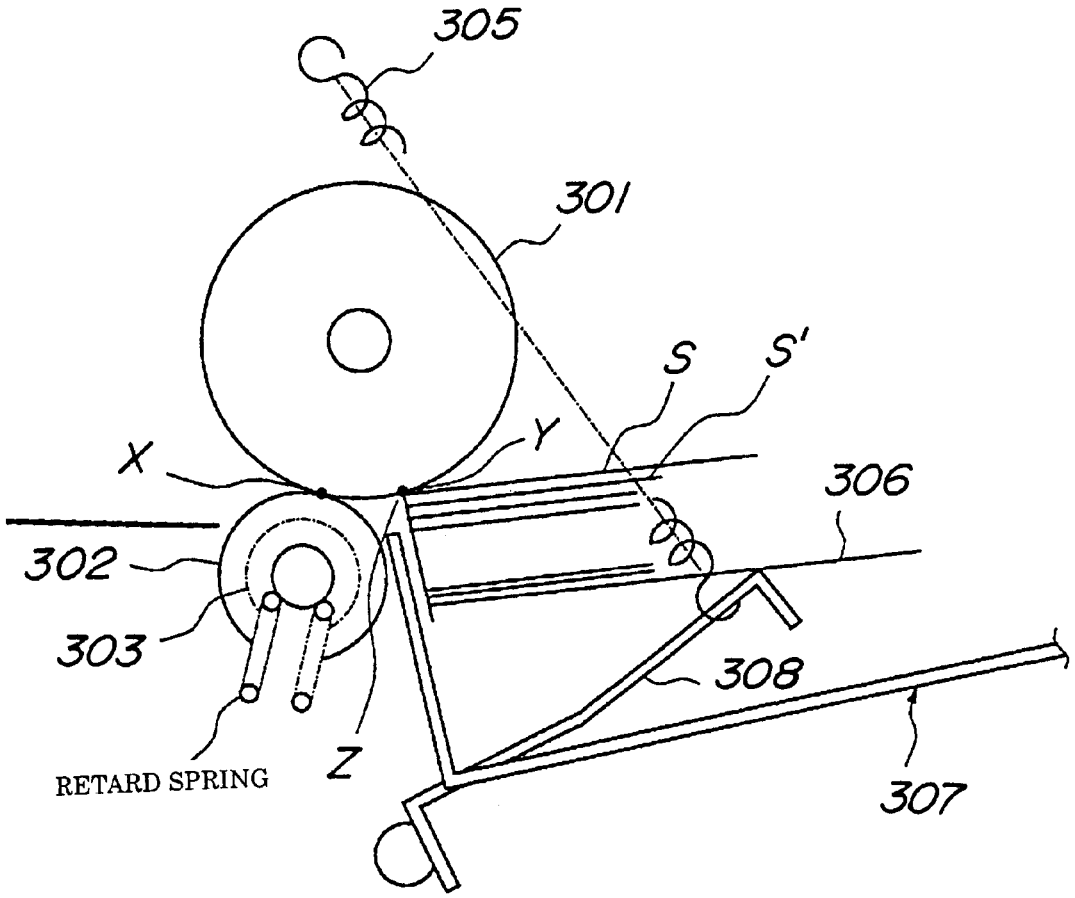
FIG. 20 (PRIOR ART)
FIG. 20 is a schematic cross section of a second prior art.

As another modified embodiment as extension of the above embodiment, as shown in FIG. 18, it is conceivable that a one-way clutch 158 is formed at the sheet feeding roller shaft 152 for preventing the sheet feeding roller 151 from rotating reversely. With the above embodiment, the operation timings of the sheet feeding roller 151 and the separating roller 153 are synchronized because the sheet feeding roller 151 may reversely rotate along with the separating roller 153, from the structure, if the separating roller 153 is driven while the sheet feeding roller 151 stops. This embodiment can have adequate stability relating to the sheet separation, but to improve the separation ability, drive in a direction returning the sheets is required to be inputted to the separating roller 153 while the sheet feeding roller 151 stops.

Therefore, to provide the one-way clutch 158 at the sheet feeding roller shaft 152, both can be operated at different timings freely. In utilizing this, separating drive can be inputted continuously to the separating roller 153 while the sheet feeding roller 151 stops temporarily.

Moreover, where the drive of the separating roller 153 is started at an earlier stage than the timing for starting pickup operation of the sheets made by the sheet feeding roller 151 at the beginning of the sheet feeding operation, an extra angle that has to be rotated before the torque limiter 162 produces the predetermined restoring force and attachment errors around the separating roller can be cancelled in advance, so that sheet separating ability can be improved further.

As described above in detail, with the embodiment as described above, the rotation controlling portion 180 inputs drive such that the separating roller 153 can rotate at a high circumferential speed at the initial period of the sheet feeding operation at which rushing of sheet bundle causing double feeding easily occurs otherwise, and the transmitting gear 157 makes lower the circumferential speed of the separating roller 153 during the drawing operation of the pair of draw rollers 55 after sheet separation is settled, thereby rendering the separating roller 153 drive at a low speed in consideration for reduction of the conveyance load as the priority matter. In summary, an optimum circumferential speed of the separating roller 153 can be selected corresponding to the stages of the feeding and circumstances. This makes compatible maintaining durability in the pair of draw rollers 55 and the high sheet separating ability, which are not possible in the prior arts.

Rotating and stopping operations of the sheet feeding roller 151 and the separating roller shaft 154, and application and release of the pressure of the intermediate plate 70 against the sheet feeding roller 115 are made in association of the single solenoid 169, the spring clutch 168, and the rotation controlling portion 180 driving for one revolution, so that the structure is simplified. Moreover, an electromagnetic clutch that is necessary for conventional sheet feeding apparatuses becomes unnecessary, so that the costs for feeding apparatus can be reduced.

With the embodiment as described above, the sheet feeding roller 151 and the separating roller 153, though receiving a rotation resistance from the torque limiter, can rotate in either direction freely with respect to the normal rotation direction of the sheet feeding roller 151 while the rotation controlling portion 180 is in the initial state, and can rotate with almost no load by operation of the one-way clutch 158 with respect to the rotation in a direction opposite to the sheet conveyance direction.

Therefore, when paper jamming occurs at the sheet feeding section, jammed paper can be pulled in either of the sheet feeding direction and the reverse sheet feeding direction, and furthermore, with respect to the reverse sheet feeding direction, the use can pull the jammed paper without feeling any load, so that the jamming handling property for users is greatly improved.

The sheet is temporarily stopped at a time that the sheet S is conveyed right before the pair of draw rollers 55, and the intermediate plate 70 is then estranged. This operation cancels deviations in pressure release timings of the intermediate plate 70 caused by the stacked sheets in a plural number, so that very stable operation can be done.

Moreover, in this apparatus, the intermediate plate 70 is pressed to and estranged from the sheet feeding roller 151 to perform the pickup operation, so that any pickup roller like in the prior art becomes unnecessary, so that a very compact apparatus can be provided inexpensively.

At the initial state, because the intermediate plate 70 is spaced from the sheet feeding roller 151, the user may not be disturbed in manipulations to set the sheet bundle. The user also can set the sheet bundle accurately not more than hitting the leading end of the sheet bundle to the sheet hitting plate 78 when the user sets the sheet bundle, and the manipulations is very easy and good in controllability. Therefore, the apparatus can be prevented from paper jamming due to user's mistaken handling, so that a shutter member or shutter controlling means likewise in the prior art are not necessary. This simplification makes the compact apparatus provided with lower costs.

The above associated operation among the intermediate plate 70, the sheet feeding roller 151, and the separating roller shaft 154 is made by the cam portion 180*c* moving the intermediate plate 70 and the rotation controlling portion 180 formed unitedly with the first notched gear 185*a* and the second notched gear 185*b* having the toothless portions, respectively. Therefore, pre-feeding timing, re-feeding timing, and pressing and estranging timings of the intermediate plate 70 are determined only the toothless portions of the respective notched gears and the phase angle of the cam portion 180*c*, so that stable feeding and separating operations can be realized with very few factors of deviations.

Rotating and stopping of the sheet feeding roller 151 and the separating roller shaft 154 and application and release of the pressure of the intermediate plate 70 can be done only by turning on and off of the solenoid 168 at one time, so that the drive becomes very easy, and so that drive precision requirements become not so restricted. Therefore, as a matter of course, the apparatus is greatly simplified.

Although in the embodiment as described above, the rotation controlling portion 180 is described as a united body constituted of the gear portion and the cam portion, those can be structured as divided so as to have an adjusted phase angle.

Although in the embodiment as described above, a spring clutch is used as a method for driving for one turn of the rotation controlling portion 180, this invention is not limited to this structure, and for example, the feeding motor M1 can be driven for one turn by a stepping motor.

Although in the embodiment as described above, the feeding motor M1 is used as the driving means for the sheet feeding roller 151, the separating roller 154, and the intermediate plate 70 where the draw motor M2 is used as the driving means for pair of draw rollers 55, this invention is not limited to this, and drive can be shared from the main motor or the like for driving the photosensitive drum 12 and the fixing apparatus 22.

Although in the embodiment as described above, two toothless portions whose phase is synchronized to one another are formed at the respective notched gears, the second toothless portion 180*b* and the fourth toothless portion can be eliminated.

In the case where the second toothless portion 180*b* and the fourth toothless portion are eliminated, timing deviation in pressure release, though could be slight, may occur with respect to the conveyance position of the sheet S due to stacked number of the sheets because the sheet does not stop temporarily during the pre-feeding of the sheet S. However, since the intermediate plate 70 can make a space until the leading end of the sheet S reaches the pair of draw rollers 55, the separating operation made by the separating roller 153 is not disturbed, so that double feeding can be prevented. In such a case, since the sheet S is not stopped temporarily during the pre-feeding operation as descried above, the sheet feeding operation can be done with shorter time interval by that portion, so that this is effective as means for raising productivity.

Although in the embodiment as described above, the sheet feeding apparatus of the invention is illustrated as an example that the sheet feeding apparatus is applied to the multiple feeding section, the invention is applicable to a cassette feeding section or a deck feeding section.

Although in the embodiment as described above, the sheet feeding apparatus of the invention is illustrated as an example that the sheet feeding apparatus is applied to a photocopier serving as an image forming apparatus, this invention is not limited to this. For example, this invention is applicable to an image reading apparatus by forming an image reading section on a downstream side of the invented sheet feeding apparatus in the sheet conveyance direction.

What is claimed is:

1. A sheet feeding apparatus comprising:

a sheet supporting means for supporting sheets;

a feeding means for feeding the sheets on the sheet supporting means in a sheet feeding direction;

a separating means for rotating in a direction opposite to the sheet feeding direction to separate the sheets sheet by sheet in pressurized contact with the feeding means; and a transmitting means for transmitting drive force of the feeding means to the separating means, wherein a circumferential speed of the separating means is set smaller than a circumferential speed of the feeding means.

2. The sheet feeding apparatus according to claim 1, wherein the circumferential speed of the separating means is set in a range from 20% to 60% of the circumferential speed of the feeding means.

3. The sheet feeding apparatus according to claim 2, further comprising a torque limiter means for providing a prescribed torque to the separating means.

4. The sheet feeding apparatus according to claim 1, further comprising a torque limiter means for providing a prescribed torque to the separating means.

5. A sheet feeding apparatus comprising:

a sheet supporting means capable of changing a position thereof for supporting sheets;

a sheet feeding roller in pressurized contact with the sheets supported to the sheet supporting means for feeding the sheets by rotation in a sheet feeding direction;

a separating roller in pressurized contact with the sheet feeding roller for rotating in a direction returning the sheets to separate the sheets fed from the sheet feeding roller sheet by sheet; and a transmitting means for transmitting drive transmitted to a sheet feeding roller shaft rotatably supporting the sheet feeding roller to a separating roller shaft rotatably supporting the separating roller, wherein a circumferential speed of the separating roller is set smaller than a circumferential speed of the sheet feeding roller.

6. The sheet feeding apparatus according to claim 5, wherein the circumferential speed of the separating roller is set in a range from 20% to 60% of the circumferential speed of the sheet feeding roller.

7. The sheet feeding apparatus according to claim 5, wherein the separating roller has a torque limiter means for providing a prescribed torque to the separating roller.

8. The sheet feeding apparatus according to claim 5, further comprising a switching means capable of switching between a connecting state in which the driving means transmits the drive from the sheet feeding roller to the separating roller shaft and a non-connecting state in which no drive is transmitted to the separating roller and of maintaining the separating roller in a state of stopping with holding a prescribed torque during the non-connecting state.

9. The sheet feeding apparatus according to claim 8, wherein the switching means includes an idler gear movable, transmits the drive to the separating roller shaft by meshing the idler gear with the sheet feeding driving gear during the connecting state, and makes the separating roller shaft not rotating by moving the idler gear to a position not transmitting the drive to the separating roller shaft from the meshing position between the idler gear and the sheet feeding driving gear during the non-connecting state.

10. The sheet feeding apparatus according to claim 5, further comprising:

a conveying means disposed on a downstream side of the sheet feeding roller in the sheet feeding direction for conveying the sheets fed from the sheet feeding roller;

a driving means for rotating and stopping the sheet feeding roller; and a pressing and estranging means for moving the sheet supporting means that has been in pressurized contact with the sheet feeding roller to disengage pressurized contact between the sheet feeding roller and the sheet before the leading edge of the sheet fed from the sheet supporting means reaches the conveying means.

11. The sheet feeding apparatus according to claim 10, wherein the driving means includes a separating roller gear formed at the separating roller shaft, and an idler gear coupling the sheet feeding driving gear with the separating roller gear.

12. The sheet feeding apparatus according to claim 10, wherein the pressing and estranging means includes a came formed unitedly with the notched gear, a cam follower provided in contact with the cam and formed at the sheet supporting means, and a pressing spring for urging the sheet supporting means in a sheet feeding roller direction as to render the sheet supporting means in contact with the sheet feeding roller.

13. The sheet feeding apparatus according to claim 10, wherein the driving means includes a notched gear having a partial toothless portion, and a sheet feeding driving gear disposed at a position in mesh with the notched gear for rotating unitedly with the sheet feeding roller.

14. The sheet feeding apparatus according to claim 13, wherein sheet feeding is stopped temporarily by facing the sheet feeding driving gear and the toothless portion of the notched gear with each other before the sheet fed by sheet feeding roller reaches the conveying means, and at that time the pressing and estranging means moves the position of the sheet supporting means to disengage the pressurized contact between the sheet feeding roller and the sheet.

15. The sheet feeding apparatus according to claim 10, wherein the driving means includes a fixed amount rotating means for rotating the notched gear in a prescribed fixed amount.

16. The sheet feeding apparatus according to claim 15, wherein the fixed amount rotating means includes a clutch for rotating the notched gear for one turn, and a solenoid for operating the clutch.

17. An image forming apparatus comprising:

a sheet feeding apparatus comprising:

a sheet supporting means for supporting sheets;

a feeding means for feeding sheets on the sheet supporting means in a sheet feeding direction;

a separating means in pressurized contact with the feeding means for rotating in a direction opposite to the sheet feeding direction to separate the sheets sheet by sheet; and a transmitting means for transmitting drive force of the feeding means to the separating means;

wherein a circumferential speed of the separating means is set smaller than a circumferential speed of the feeding means, and an image forming means for forming images on the sheet fed from the sheet feeding apparatus.

18. An image reading apparatus comprising:

a sheet feeding apparatus comprising:

a sheet supporting means for supporting sheets;

a feeding means for feeding sheets on the sheet supporting means in a sheet feeding direction;

a separating means in pressurized contact with the feeding means for rotating in a direction opposite to the sheet feeding direction to separate the sheets sheet by sheet; and a transmitting means for transmitting drive force of the feeding means to the separating means;

wherein a circumferential speed of the separating means is set smaller than a circumferential speed of the feeding means, and an image reading means for reading image information on the sheet fed from the sheet feeding apparatus.

19. An image forming apparatus comprising:

a sheet feeding apparatus comprising:

a sheet supporting means capable of changing a position thereof for supporting sheets;

a sheet feeding roller in pressurized contact with the sheets supported to the sheet supporting means for feeding the sheets by rotation in a sheet feeding direction;

a separating roller in pressurized contact with the sheet feeding roller for rotating in a direction returning the sheets to separate the sheets fed from the sheet feeding roller sheet by sheet; and a transmitting means for transmitting drive transmitted to a sheet feeding roller shaft rotatably supporting the sheet feeding roller to a separating roller shaft rotatably supporting the separating roller, wherein a circumferential speed of the separating roller is set smaller than a circumferential speed of the sheet feeding roller, and an image forming means for forming images on the sheet fed from the sheet feeding apparatus.

20. An image reading apparatus comprising:

a sheet feeding apparatus comprising:

a sheet supporting means capable of changing a position thereof for supporting sheets;

a sheet feeding roller in pressurized contact with the sheets supported to the sheet supporting means for feeding the sheets by rotation in a sheet feeding direction;

a separating roller in pressurized contact with the sheet feeding roller for rotating in a direction returning the sheets to separate the sheets fed from the sheet feeding roller sheet by sheet; and a transmitting means for transmitting drive transmitted to a sheet feeding roller shaft rotatably supporting the sheet feeding roller to a separating roller shaft rotatably supporting the separating roller, wherein a circumferential speed of the separating roller is set smaller than a circumferential speed of the sheet feeding roller, and an image reading means for reading image information on the sheet fed from the sheet feeding apparatus.

21. A sheet feeding apparatus comprising:

a sheet supporting means for supporting sheets;

a feeding means for feeding the sheets on the sheet supporting means in a sheet feeding direction; and a separating means for rotating in a direction opposite to the sheet feeding direction to separate the sheets sheet by sheet in pressurized contact with the feeding means;

wherein a circumferential speed of the separating means can be switched during the sheet feeding operation of one sheet.

22. The sheet feeding apparatus according to claim 21, further comprising a conveying means disposed on a downstream side of a separating portion at which the feeding means and the separating means are in contact with each other in the sheet feeding direction for conveying the sheet by nipping the sheet, wherein the circumferential speed of the separating means is switched after the sheet fed from the feeding means reaches the conveying means.

23. The sheet feeding apparatus according to claim 21, wherein the sheet supporting means is structured to be movable, and the sheet is fed while the supported sheet is pressingly contacted with the feeding means by changing the position of the sheet supporting means.

24. The sheet feeding apparatus according to claim 21, wherein the separating means has a torque limiter means for providing to the separating means a load in a direction opposite to the sheet feeding direction.

25. The sheet feeding apparatus according to claim 21, wherein the apparatus satisfy a relation of $0 \leqq V2 < V1$ where the circumferential speed before switching of the separating means is V1 and the circumferential speed after switching is V2.

26. The sheet feeding apparatus according to claim 25, further comprising a conveying means disposed on a downstream side of a separating portion at which the feeding means and the separating means are in contact with each other in the sheet feeding direction for conveying the sheet by nipping the sheet, wherein the circumferential speed of the separating means is switched after the sheet fed from the feeding means reaches the conveying means.

27. The sheet feeding apparatus according to claim 21, wherein the feeding means has a sheet feeding roller held rotatably to a sheet feeding roller shaft, and wherein the separating means has a separating roller rotatably supported to a separating roller shaft.

28. The sheet feeding apparatus according to claim 27, further comprising a torque limiter means disposed between the separating roller shaft and the separating roller for providing to the separating roller a load in a direction opposite to the sheet feeding direction.

29. The sheet feeding apparatus according to claim 21, further comprising:

a driving means for driving the feeding means and the separating means;

a first transmitting means for transmitting drive of the driving means to the feeding means;

a second transmitting means for transmitting drive of the driving means to the separating means; and a third transmitting means for transmitting rotation of the feeding means to the separating means, wherein, when the drive transmission by the first transmitting means to the feeding means and the drive transmission by the second transmitting means to the separating means are cut off or when only the drive transmission by the second transmitting means to the separating means is cut off, the third transmitting means transmits the rotation of the feeding means to the separating means, and the circumferential speed of the separating means is switched.

30. The sheet feeding apparatus according to claim 29, wherein the first transmitting means has a first notched gear held to a drive shaft rotating by drive of the driving means having a toothless portion located on one portion or portions, and a sheet feeding driving gear rotatably supported by the sheet feeding roller shaft in capable of meshing the first notched gear, wherein the second transmitting means has a second notched gear held to a drive shaft of the driving means having a toothless portion located on one portion or portions, and a separating driving gear rotatably supported by the separating roller shaft in capable of meshing the second notched gear, wherein the third transmitting means has a feeding transmitting gear formed at the sheet feeding roller shaft, a separating transmitting gear formed via a one-way clutch at the separating roller shaft, and an idler gear connecting the feeding transmitting gear and the separating transmitting gear with each other, and wherein the drive of the driving means transmitted to the sheet feeding roller and the separating roller is made cut off when the toothless portion of the first notched gear reaches a position facing to the sheet feeding driving gear and when the toothless portion of the second notched gear reaches a position facing to the separating driving gear.

31. The sheet feeding apparatus according to claim 30, wherein the drive of the driving means is made cut off after the sheet fed by the sheet feeding roller reaches the conveying means.

32. An image forming apparatus comprising:

a sheet feeding apparatus comprising:

a sheet supporting means capable of changing a position thereof for supporting sheets;

a sheet feeding roller in pressurized contact with the sheets supported to the sheet supporting means for feeding the sheets by rotation in a sheet feeding direction;

a separating roller in pressurized contact with the sheet feeding roller for rotating in a direction returning the sheets to separate the sheets fed from the sheet feeding roller sheet by sheet; and a transmitting means for transmitting drive transmitted to a sheet feeding roller shaft rotatably supporting the sheet feeding roller to a separating roller shaft rotatably supporting the separating roller, wherein a circumferential speed of the separating roller is set smaller than a circumferential speed of the sheet feeding roller, and an image forming means for forming images on the sheet fed from the sheet feeding apparatus.

33. An image reading apparatus comprising:

a sheet feeding apparatus comprising:

a sheet supporting means capable of changing a position thereof for supporting sheets;

a sheet feeding roller in pressurized contact with the sheets supported to the sheet supporting means for feeding the sheets by rotation in a sheet feeding direction;

a separating roller in pressurized contact with the sheet feeding roller for rotating in a direction returning the sheets to separate the sheets fed from the sheet feeding roller sheet by sheet; and a transmitting means for transmitting drive transmitted to a sheet feeding roller shaft rotatably supporting the sheet feeding roller to a separating roller shaft rotatably supporting the separating roller, wherein a circumferential speed of the separating roller is set smaller than a circumferential speed of the sheet feeding roller, and an image reading means for reading images set forth on the sheet fed from the sheet feeding apparatus.

* * * * *

UNITED STATES PATENT AND TRADEMARK OFFICE

CERTIFICATE OF CORRECTION

PATENT NO. : 6,382,622 B1
DATED : May 7, 2002
INVENTOR(S) : Hideaki Takada et al.

Figure 7:
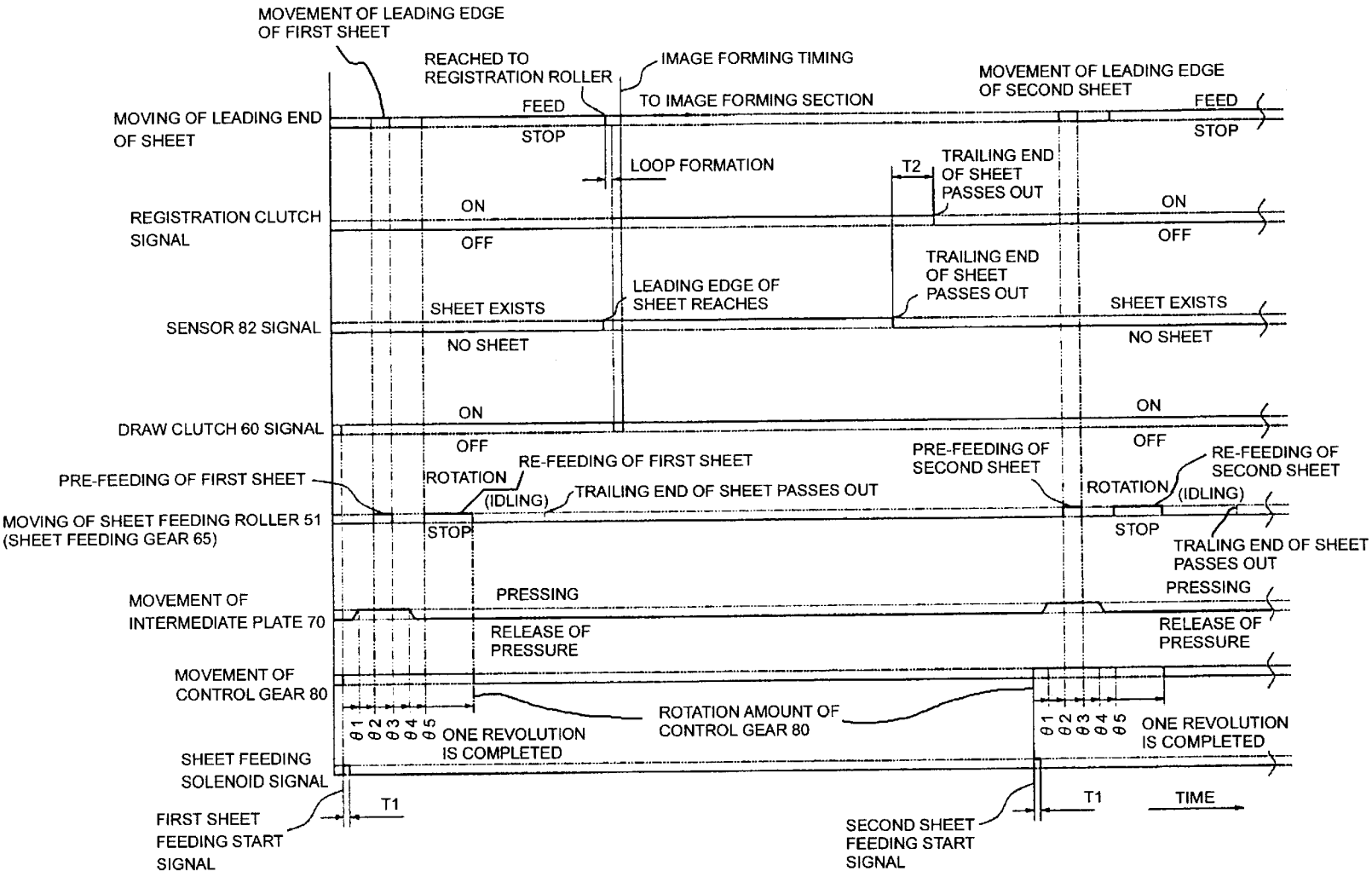
FIG. 7 is a timing chart at a time of feeding.

It is certified that error appears in the above-identified patent and that said Letters Patent is hereby corrected as shown below:

Drawings,
Sheet 7, Figure 7, “TRALING” should read -- TRAILING --.
Sheet 7, Figure 17, “TRAILING” should read -- TRAILING --.

Column 2,
Line 62, “a” should read -- an --.

Column 4,
Line 37, “(is);” should be -- *(is)*; --.
Line 57, “an” should read -- a --.

Column 7,
Line 23, “directions” should read -- direction --.

Column 14,
Line 6, “scarifying” should read -- sacrificing --.
Line 37, “smaller” should read -- small --.
Line 40, “worsen” should read -- worse --.

Column 16,
Line 43, “shorten” should read -- shortened --.

Column 17,
Line 60, “an”should be deleted.

Column 18,
Line 15, “an” should read -- a --.

Column 23,
Line 14, “151.” should read -- 151. Then, the --.
Line 15, “1 80,” should read -- 180, --.

Column 26,
Line 20, “to” should be deleted.

Column 32,
Line 3, “movable,” should be deleted.
Line 28, “came” should read -- cam --.

UNITED STATES PATENT AND TRADEMARK OFFICE

CERTIFICATE OF CORRECTION

PATENT NO. : 6,382,622 B1
DATED : May 7, 2002
INVENTOR(S) : Hideaki Takada et al.

It is certified that error appears in the above-identified patent and that said Letters Patent is hereby corrected as shown below:

Column 34,
Line 29, “satisfy” should read -- satisfies --.

Column 35,
Line 8, “in” should read -- is --.
Line 14, “in” should read -- is --.

Signed and Sealed this

Eighth Day of October, 2002

*Attest:*

*Attesting Officer*

JAMES E. ROGAN
*Director of the United States Patent and Trademark Office*